US008256624B2

(12) United States Patent
Doi et al.

(10) Patent No.: US 8,256,624 B2
(45) Date of Patent: Sep. 4, 2012

(54) MONEY HANDLING APPARATUS AND DISPENSING METHOD THEREOF

(75) Inventors: Kazuhiro Doi, Hyogo (JP); Kenichi Tagashira, Chiba (JP)

(73) Assignee: Glory Ltd., Himeji (JP)

( * ) Notice: Subject to any disclaimer, the term of this patent is extended or adjusted under 35 U.S.C. 154(b) by 652 days.

(21) Appl. No.: 12/410,585

(22) Filed: Mar. 25, 2009

(65) Prior Publication Data

US 2010/0245043 A1 Sep. 30, 2010

(51) Int. Cl.
*B07C 5/00* (2006.01)

(52) U.S. Cl. ..... 209/534; 194/206; 194/207; 902/12; 902/14

(58) Field of Classification Search ..... 209/534; 194/206, 207; 902/12, 13, 14, 15
See application file for complete search history.

(56) References Cited

U.S. PATENT DOCUMENTS

| | | | | |
|---|---|---|---|---|
| 4,596,924 | A * | 6/1986 | Watanabe | 235/379 |
| 5,076,441 | A * | 12/1991 | Gerlier | 209/534 |
| 6,000,555 | A * | 12/1999 | Anma | 209/534 |
| 6,752,367 | B2 * | 6/2004 | Yamashita et al. | 248/312 |
| 7,694,797 | B2 * | 4/2010 | Takeuchi et al. | 194/206 |
| 2004/0016621 | A1 * | 1/2004 | Jenrick et al. | 194/206 |
| 2010/0108576 | A1 * | 5/2010 | Wada et al. | 209/534 |

FOREIGN PATENT DOCUMENTS

| | | | |
|---|---|---|---|
| EP | 0831432 | A2 | 3/1998 |
| EP | 1130551 | A2 | 9/2001 |
| JP | 3614465 | B2 | 1/2005 |
| JP | 3983992 | B2 | 9/2007 |

* cited by examiner

*Primary Examiner* — Joseph C Rodriguez
(74) *Attorney, Agent, or Firm* — Foley & Lardner LLP

(57) ABSTRACT

A money handling apparatus includes a storage and feed unit that stores or feeds moneys, a transport unit that transports the moneys to the storage and feed unit or to outside of the apparatus, a deposit reject port that ejects a deposit reject money recognized as an improper money at the time of deposit processing so that it can be taken out from outside of the apparatus, and a transport control unit that controls the transport unit so that the moneys fed out by the storage and feed unit at the time of dispensing processing to the deposit reject port.

10 Claims, 22 Drawing Sheets

FIG.2

| | (1) | | (2) | | (3) | | (4) | |
|---|---|---|---|---|---|---|---|---|
| PARTS OF APPARATUS | OWNER-SHIP | HANDLING RIGHT | OWNERSHIP | HANDLING RIGHT | OWNER-SHIP | HANDLING RIGHT | OWNER-SHIP | HANDLING RIGHT |
| DEPOSITING AND DISPENSING UNIT | SHOP | | SHOP | SHOP OPERATOR, SHOP MANAGER | SHOP | SHOP OPERATOR, SHOP MANAGER | SHOP | SHOP OPERATOR, SHOP MANAGER |
| STORAGE AND FEED UNIT | BANK | | BANK | REPRESENTATIVE OF BANK | BANK | REPRESENTATIVE OF BANK (OR SHOP, CONDITIONALLY) | SHOP | SHOP MANAGER |
| STORAGE UNIT | SPECIFIED PERSON FOR COLLECTION | | SPECIFIED PERSON FOR COLLECTION | SPECIFIED PERSON FOR COLLECTION | BANK | SPECIFIED PERSON FOR COLLECTION | BANK | SPECIFIED PERSON FOR COLLECTION |

FIG.13

Banknotes for one transaction are being dispensed by denomination.
Ten-dollar banknotes will be dispensed after banknotes accumulated at dispensing port have been removed.

TRANSACTION NO. 00012 PREPARATION OF CHANGES (REGISTER NO. 1)
AMOUNT OF CHANGE FUND: $1540
AMOUNT OF PREPARED CHANGE: $780

DISPENSING PORT: $50 → $10
TRANSACTION NO. 00012
DISPENSING OF $50 BANKNOTES IS COMPLETE. 10/10 SHEETS

DEPOSITING REJECT PORT: $20
TRANSACTION NO. 00012
DISPENSING OF $20 IS IN PROGRESS. 14/20 SHEETS

FIG.15

Continuous dispensing of change fund is in progress.
Change fund for register NO. 3 will be dispensed after banknotes accumulated at dispensing port have been removed.

DISPENSING PORT: REGISTER NO. 1 → REGISTER NO. 3

| | |
|---|---|
| TRANSACTION NO. 00012 | AMOUNT OF CHANGE FUND: $1540 |
| PREPARATION OF CHANGES (REGISTER NO. 1) | AMOUNT OF PREPARED CHANGE: $1540 |

PREPARATION OF CHANGE FUND FOR REGISTER NO. 1 IS COMPLETE!

DEPOSITING REJECT PORT: REGISTER NO. 2

| | |
|---|---|
| TRANSACTION NO. 00013 | AMOUNT OF CHANGE FUND: $1540 |
| PREPARATION OF CHANGES (REGISTER NO. 2) | AMOUNT OF PREPARED CHANGE: $780 |

CHANGE FUND FOR REGISTER NO. 2 IS BEING DISPENSED.

1: DEPOSITING AND DISPENSING UNIT
2: STORAGE AND FEED UNIT
3: STORAGE UNIT

FIG.21
(a)
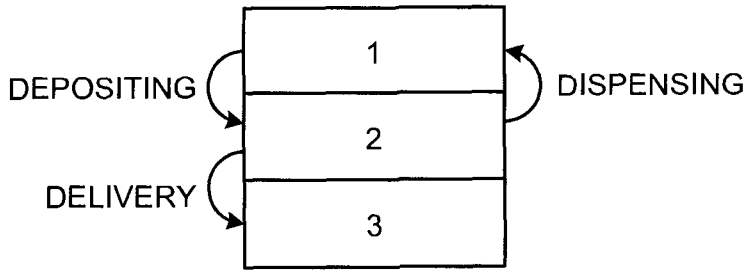
(b)
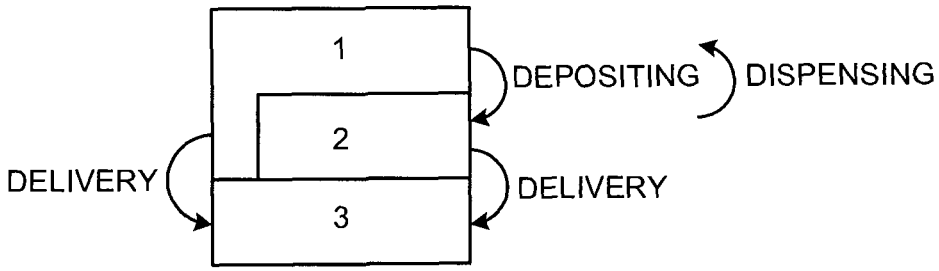
(d)
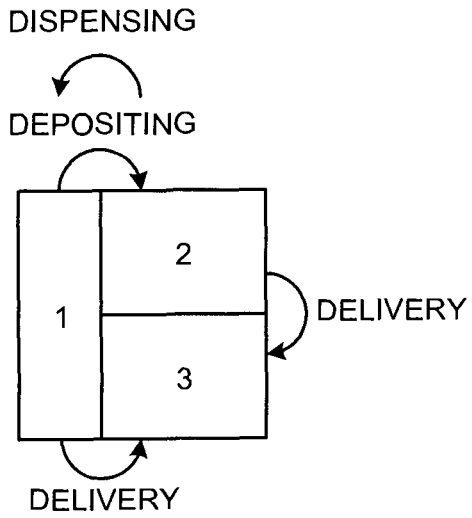

MONEY HANDLING APPARATUS AND DISPENSING METHOD THEREOF

BACKGROUND OF THE INVENTION

1. Field of the Invention

The present invention relates to a money handling apparatus and a dispensing method thereof, and, more particularly to a money handling apparatus having a deposit reject port that ejects deposit-rejected banknotes recognized as improper banknotes at the time of depositing, and a dispensing method thereof.

2. Description of the Related Art

Conventionally, a money handling apparatus that performs deposit processing of sales proceeds or the like and dispensing processing of changes or the like is installed at a backyard of a shop.

As this type of the money handling apparatus, for example, a circulation-type banknote depositing and dispensing machine that carries deposited banknotes put therein from a banknote deposit port and recognized to a dispensing port is disclosed in Japanese Patent No. 3614465.

Further, a banknote depositing and dispensing processing system including a banknote depositing and dispensing processing unit that carries banknotes fed from a banknote storage unit to a dispensing port at the time of dispensing banknotes, while carrying a deposit-rejected banknote put therein from a deposit port and recognized at the time of depositing of banknotes is disclosed in Japanese Patent No. 3983992. The deposit-rejected banknote means a banknote recognized as an unidentifiable banknote, a counterfeit banknote, a banknote deposited in a chained state, or a severely damaged banknote.

However, the apparatuses disclosed in the above two documents naturally have limitations in efficiently performing the dispensing processing as described below.

For example, when the dispensing processing is performed continuously, money associated with the next dispensing process cannot be transported unless the dispensed money already transported to the dispensing port is removed, thereby decreasing efficiency in the dispensing process.

That is, there is a waiting time for waiting for the dispensed banknote to be removed after completion of transport of the dispensed banknote associated with a transaction until transport of the dispensed banknote associated with the next transaction is started. Therefore, as the waiting time becomes long, the time required for continuous dispensing becomes long.

Particularly, when the dispensing processing is performed for preparing change fund for the next business day in the shop, the dispensing processing occurs in all registers present in the shop. Therefore, large delay can be caused in a closing operation.

This problem occurs not only when banknotes are dispensed continuously but also when banknotes are dispensed exceeding a storable capacity in the dispensing port.

When the dispensing port has a malfunction such as a paper jam, the dispensing processing itself cannot be performed, and the processing can stagnate.

SUMMARY OF THE INVENTION

It is an object of the present invention to at least partially solve the problems in the conventional technology.

A money handling apparatus for handling money according to an aspect of the present invention includes a depositing unit that deposits a money; a transport unit that transports the money; a recognition unit that recognizes the money; a money storage unit that stores the money; a dispensing unit that dispenses the money; a reject unit that ejects a rejected money that cannot be accepted; and a control unit that controls the recognition unit to recognize the money deposited from the depositing unit, and controls the transport unit to transport a genuine money recognized as an acceptable money by the recognition unit to the money storage unit and to transport a rejected money recognized as an unacceptable money by the recognition unit to the reject unit. The control unit controls the transport unit such that a money dispensed from the money storage unit is transported to the dispensing unit and the reject unit under a predetermined condition.

A dispensing method according to another aspect of the present invention, which is applied to a money handling apparatus for handling money, includes controlling a recognition unit for recognizing a money to recognize a deposited money from a depositing unit in which moneys are deposited; and controlling a transport unit for transporting the money to transport a genuine money recognized as an acceptable money by the recognition unit to a money storage unit for storing the moneys, and to transport a reject money recognized as an unacceptable money by the recognition unit to a reject unit for ejecting a reject money. Transport unit is controlled such that a money dispensed from the money storage unit is transported to a dispensing unit for dispensing a money and the reject unit under a predetermined condition.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 2 is an explanatory diagram for explaining diversity of divisions of a handling right according to the embodiment;

FIG. 13 is an example of a screen displayed on the operation terminal;

FIG. 15 is an example of a screen to be displayed on the operation terminal;

FIG. 21 depicts banknote transport in the application example of the layout shown in FIG. 20;

DETAILED DESCRIPTION OF THE PREFERRED EMBODIMENTS

Exemplary embodiments of a money handling apparatus and a dispensing method thereof according to the present invention will be explained below in detail with reference to the accompanying drawings. In the following explanations, for convenience sake, explanations of a coin processing apparatus having the same configuration as that of a money handling apparatus will be omitted. However, the scope of the present invention is not limited to the money handling apparatus, and the present invention is similarly applicable when both or either one of the money handling apparatus and the coin processing apparatus is present.

Figure 1:
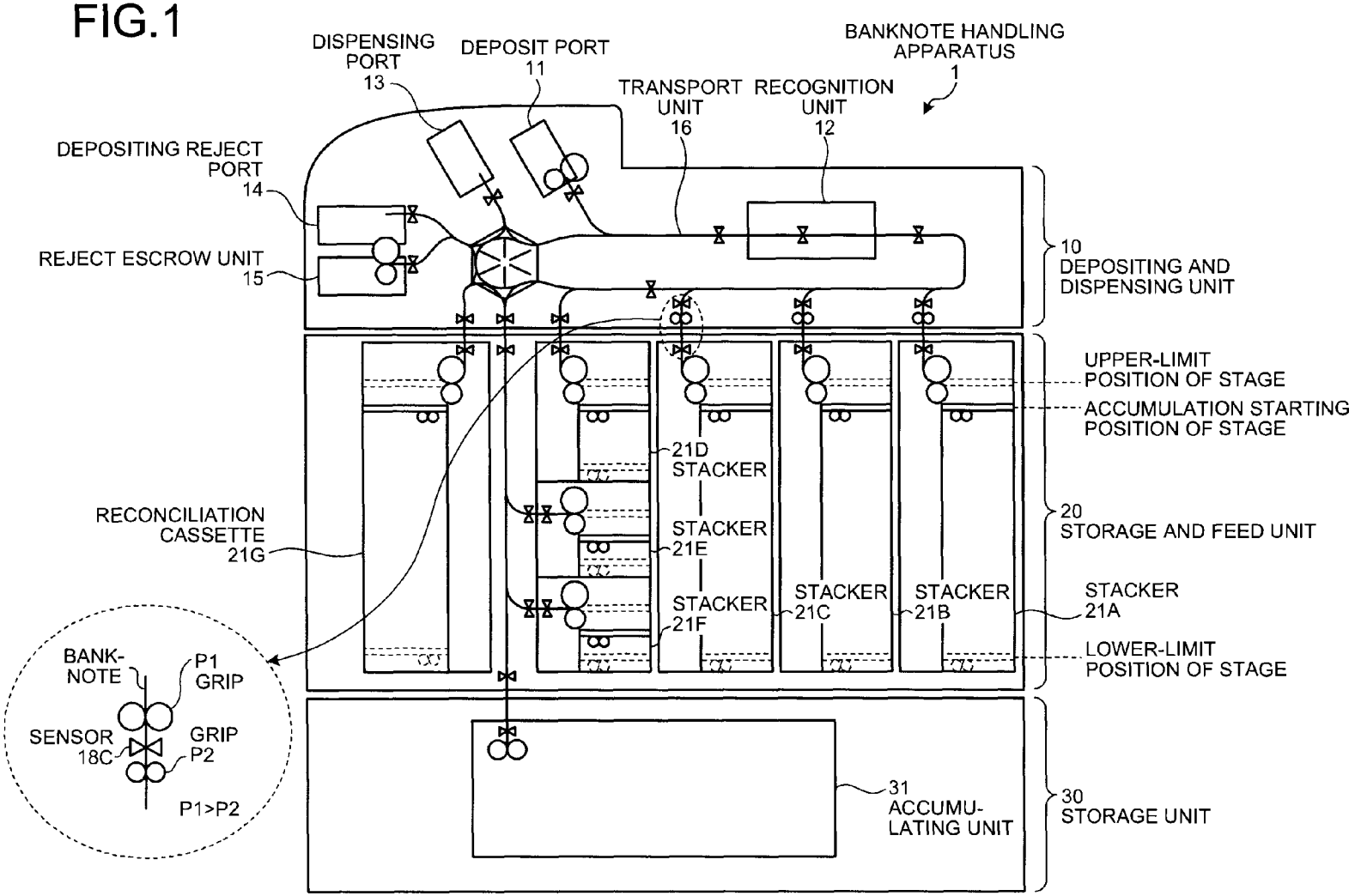
FIG. 1 is a configuration diagram of an overall configuration of a money handling apparatus according to an embodiment of the present invention.

An overall configuration of a money handling apparatus according to an embodiment of the present invention is explained first. FIG. 1 is a configuration diagram of the overall configuration of the money handling apparatus according to the present embodiment.

As shown in FIG. 1, a money handling apparatus 1 is divided into a depositing and dispensing unit 10 that performs depositing and dispensing processing of banknotes, a storage and feed unit 20 that stores and feeds banknotes, and a storage unit 30 that stores banknotes. The depositing and dispensing unit 10, the storage and feed unit 20, and the storage unit 30 are configured such that different three parties concerned can handle only a part allowed to each party.

Accordingly, in the present embodiment, three or more parties concerned can be involved in handling of banknotes.

For example, as shown in (1) of FIG. 2, a handling right of the depositing and dispensing unit 10, the storage and feed unit 20, and the storage unit 30 can be divided in various combinations of an shop operator, a person in charge of a backyard of the shop (shop manager), a banker, a representative of the banker (maintenance staff), and a specified person for collection (for example, a security guard from a security company).

In the present embodiment, an example of a case in which the handling right is given to each of the depositing and dispensing unit 10, the storage and feed unit 20, and the storage unit 30 as shown in (3) of FIG. 2 among the divisions of the handling right shown in FIG. 2 is explained.

That is, in the present embodiment, such an operation is assumed that a financial institution such as a bank leases the money handling apparatus 1 to a shop, and in business hours of the shop, transport of money is performed between the depositing and dispensing unit 10 and the storage and feed unit 20, excess cash in the storage and feed unit 20 is transportred to the storage unit 30, and the cash in the storage unit 30 is collected by a security company.

According to such an operation, debit and deposit can be freely performed as cash in a bank account of the shop, excess cash is prevented from being kept in the shop, and by using the security company for transport of cash, security is further enhanced, while improving efficiency in mobilization of money of the shop and bank.

At the time of handling the depositing and dispensing unit 10, deposit and payment is made possible through authentication using a card or password at an operation terminal 110 described later. At the time of handling the storage and feed unit 20, an inside thereof can be exposed through authentication using a card or password or a predetermined operation via a vault dial and lever (not shown). At the time of handling the storage and feed unit 20, an inside thereof can be exposed in the same manner as in the case of the storage and feed unit 20.

In the present embodiment, therefore, it can be prevented that the three parties of the shop, bank, and security company contact to the banknotes in a place other than the division allowed thereto, and thus even if there are three parties concerned, inviolability between the parties concerned can be secured.

Further, in the present embodiment, the storage and feed unit 20 and the storage unit 30 are installed in a separate vault, respectively, and one or a plurality of openings for passage of banknotes is provided in a partition of the vault at a part where the depositing and dispensing unit 10 and the storage and feed unit 20 shown in FIG. 1 adjacent to each other and at a part where the storage and feed unit 20 and the storage unit 30 adjacent to each other. Banknotes are transported through the openings for passage of banknotes, and a vault door for the storage and feed unit 20 and a vault door for the storage unit 30 are locked by a locking mechanism such as an electronic lock or mechanical lock. Accordingly, security against a third party other than the parties concerned (for example, a third party such as an illegitimate shop operator or criminals) can be enhanced rapidly.

In the present embodiment, the storage and feed unit 20 and the storage unit 30 are respectively installed in a separate vault. However, the storage and feed unit 20 and the storage unit 30 do not need to be installed in a separate vault, and these can be installed in one vault, and an adjacent part between the storage and feed unit 20 and the storage unit 30 can be isolated by a partition and a door can be installed respectively.

A configuration of each unit of the money handling apparatus according to the present embodiment is explained next. As shown in FIG. 1, the depositing and dispensing unit 10 includes a deposit port 11, a recognition unit 12, a dispensing port 13, a deposit reject port (hereinafter, "depositing reject port") 14, a reject escrow unit (hereinafter, "reject escrow unit") 15, and a transport unit 16.

The deposit port 11 is in a box shape formed by depressing a top panel of the apparatus in a concave shape to form a substantially rectangular opening. The deposited banknotes are fed therein one by one by a feed unit such as a roller provided at the bottom of the box. Because it is less secure to put the dispensing port 13 and the depositing reject port 14 in an exposed state at all times, in practice, a shutter is provided, which is opened only at the time of use.

The recognition unit 12 is a billvalid unit that recognizes a banknote, and for example, performs various types of discriminations, such as determination of genuine/counterfeit note, fit/unfit note, and type of banknote such as denomination and old or new note. In the determination of genuine/counterfeit note, the recognition unit 12 recognizes if the money is genuine or counterfeit. In the determination of fit/unfit note, the recognition unit 12 determines the money with a good condition of genuine currencies as a fit banknote, and the stained or damaged money as an unfit banknote.

The dispensing port 13 is in a box shape formed by depressing the top panel of the apparatus in a concave shape to form a substantially rectangular opening, and ejects the banknote recognized as proper banknotes by the recognition unit 12 at the time of dispensing processing, so that the dispensed banknote can be taken out from outside of the apparatus. The dispensing port 13 and the depositing reject port 14 are provided with a sensor for detecting removing (not shown) to detect removing of the banknote.

The depositing reject port 14 is in a box shape formed by depressing a front panel of the apparatus in a concave shape to form a substantially rectangular opening, which is an ejection port for ejecting a depositing reject banknote recognized as an improper banknote at the time of deposit processing so that it can be taken out from outside of the apparatus. The depositing reject banknote means a banknote recognized as an unidentifiable banknote, a counterfeit banknote, a plurality of deposited banknotes transported in a chained state, or a severely damaged banknote at the time of recognizing the deposited banknote. At the time of a dispensing transaction, as in the dispensing port 13, the dispensed banknote can be ejected so that it can be taken out from outside of the apparatus. Accordingly, various dispensing transactions can be performed using the dispensing port 13 and the depositing reject port 14.

The reject escrow unit 15 is a storage and feed unit that temporarily holds a dispensing reject banknote recognized as an unfit money at the time of dispensing processing, and has a mechanism for feeding the dispensing reject banknote into the reject escrow unit 15 and feeding out the dispensing reject banknote to the outside of the reject escrow unit 15. The dispensing reject banknote means a banknote recognized as an unidentifiable banknote, a counterfeit banknote, a plurality of dispensed banknotes transported in a chained state, or a severely damaged banknote at the time of recognizing the dispensed banknote.

The transport unit 16 has a belt conveyor including a pair of belts that puts a banknote between the belts one by one, and carries the banknote between the deposit port 11, the recognition unit 12, the dispensing port 13, the depositing reject port 14, the reject escrow unit 15, stackers 21A to 21F described later, a reconciliation cassette 21G, and an accumulating unit 31.

The storage and feed unit 20 includes the stackers 21A to 21F and the reconciliation cassette 21G as shown in FIG. 1.

The stackers 21A to 21F is a storage and feed unit that accumulate and store the banknotes fed therein, and feed out the accumulated banknotes one by one to the transport unit 16. When an accumulated amount of the banknote is zero, a stage is present at a stage starting position, and as the accumulated amount of the banknote increases, the position of the stage moves downward, and finally the stage can be moved to a lower-limit position of the stage. On the other hand, at the time of feeding out the banknotes, as the banknotes are fed out, the stage moves upward, and when all the banknotes are fed out, the stage moves to an upper-limit position of the stage.

In the present embodiment, 1-dollar banknotes are allocated to the stacker 21A, 5-dollar banknotes to the stacker 21B, 10-dollar banknotes to the stacker 21C, 20-dollar banknotes to the stacker 21D, 50-dollar banknotes to the stacker 21E, and 100-dollar banknotes to the stacker 21F. One denomination is allocated to one stacker here; however, two types of denomination can be mixed and stored in one stacker, or the same denomination can be stored in a plural stackers.

The reconciliation cassette 21G is a storage and feed unit that accumulates and stores banknotes fed therein, and feeds out the accumulated banknotes one by one to the transport unit 16, as the stackers 21A to 21F, and is configured as a cash cassette detachable from the storage and feed unit 20.

The reconciliation cassette 21G is for examining the number of banknotes stored in the stackers 21A to 21F (hereinafter, "stacker 21", when a plural stackers are collectively referred to) when the number of banknotes stored in the stacker 21 becomes uncertain due to a banknote jam (banknote clogging) or the like. After having received and stored the banknotes in the stacker 21 to be examined at the time of examination, the reconciliation cassette 21G feeds out the stored banknotes.

Further, banknotes for replenishment can be loaded into the reconciliation cassette 21G to replenish the stackers 21A to 21F with the banknotes. The reconciliation cassette 21G can be used also as a storage and feed unit as the stackers 21A to 21F. Alternatively, the reconciliation cassette 21G can be used as an overflow stacker that receives overflowing banknotes, when the stacker 21 is fully loaded with the banknotes (in a full state).

Figure 3:
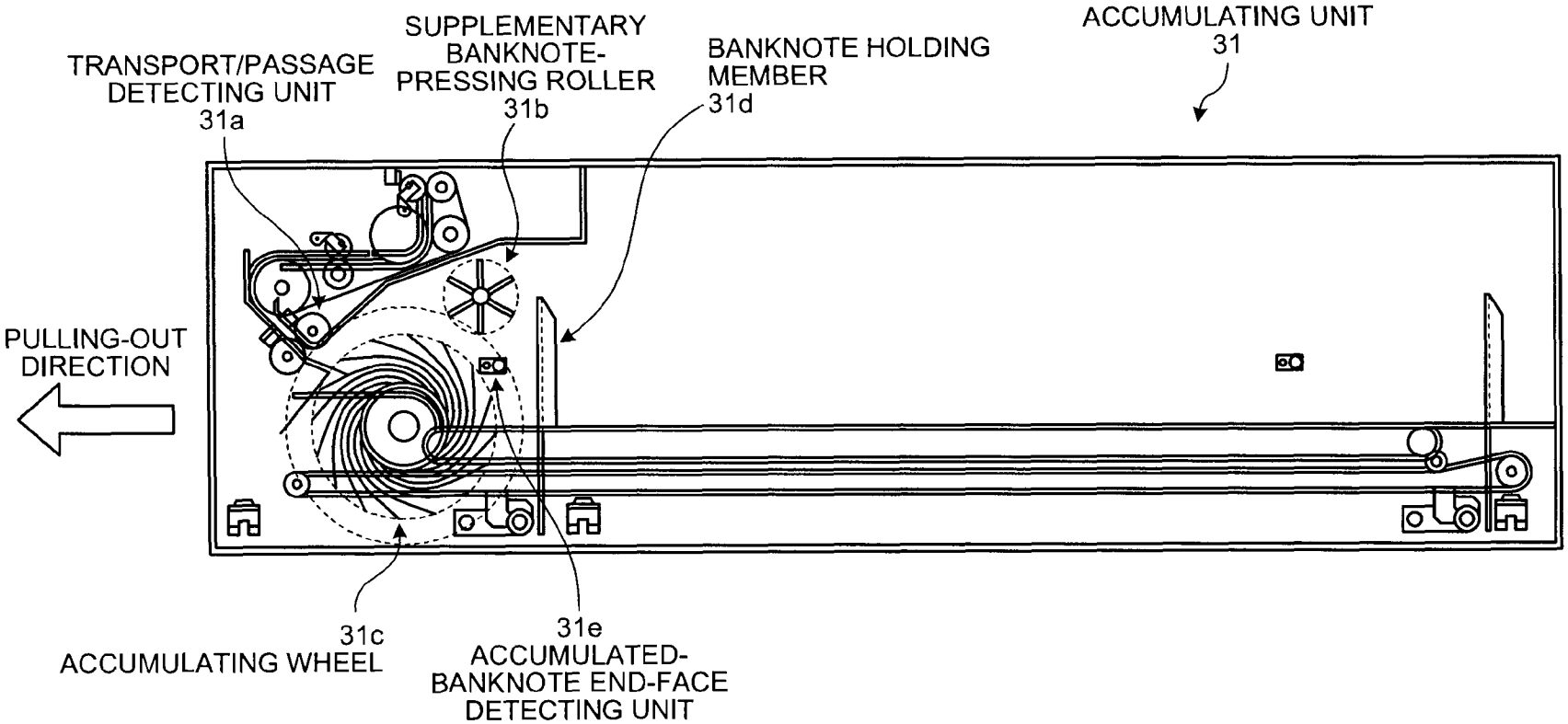
FIG. 3 is an explanatory diagram for explaining an example of a configuration of an accumulating unit.

The storage unit 30 has the accumulating unit 31 that accumulates banknotes in a horizontal direction in a state that the banknotes are aligned in a vertically standing state with faces (the surface or the back) of the banknotes being put together. The accumulating unit 31 includes therein a transport/passage detecting unit 31*a*, a supplementary banknote-pressing roller 31*b*, an accumulating wheel 31*c*, a banknote holding member 31*d*, and an accumulated-banknote end-face detecting unit 31*e*, as shown in FIG. 3.

In the accumulating unit 31, the banknotes transported by the transport unit 16 are detected by the transport/passage detecting unit 31*a*, and when a transported banknote is detected, the accumulating wheel 31*c* is rotated in a clockwise direction to entangle a banknote therein and press the banknote against the banknote holding member 31*d*, while rotating the supplementary banknote-pressing roller 31*b* in a counterclockwise direction to suppress flapping of banknotes. When the accumulated banknotes are detected by the accumulated-banknote end-face detecting unit 31*e*, the accumulating unit 31 moves the banknote holding member 31*d* backward.

The banknotes stored in the storage unit 30 are collected in a state that sales proceeds and the like are deposited after close of business of the shop, and thus the banknotes can be a huge amount. In the present embodiment, therefore, the accumulating unit 31 of a retractable type has been described so that a security guard of a security company can manually collect the banknotes aligned in a standing manner, subdivide and pack the banknotes after close of business. However, a cash cassette can be used instead. In this case, such a merit can be achieved that the security guard does not need to contact to the cash directly, as compared with the accumulating unit 31. The accumulating unit 31 can have an oblong structure, so that the banknotes are dropped into a linen bag, a resin bag or the like.

Further, in the present embodiment, the storage unit 30 that only performs storage of banknotes has been described as a third part. However, as in the storage and feed unit 20 as a second part, the third part can be formed as a storage and feed unit that also performs feed of banknotes. In this case, it can be configured such that replenishment of the banknotes from the storage and feed unit as the third part to the storage and feed unit 20 as the second part is performed via the depositing reject port 14 and the reconciliation cassette 21G.

In the present embodiment, the apparatus has a mechanism that clarifies to which division of the handling right the banknote belongs, even if a banknote jam occurs at a boundary between the depositing and dispensing unit 10 and the storage and feed unit 20.

For example, such a case is assumed that at the time of carrying 10-dollar banknotes to the stacker 21C by the transport unit 16, a banknote jam occurs at the boundary between the depositing and dispensing unit 10 and the storage and feed unit 20. At this time, as shown in an enlarged scale in FIG. 1, a difference is given between grip P1 of the carrier roller on the depositing and dispensing unit 10 side and grip P2 of the carrier roller on the storage and feed unit 20 side, to set as P1>P2.

If the grips of both carrier rollers are set in this manner, even if a banknote jam occurs at the boundary between the depositing and dispensing unit 10 and the storage and feed unit 20, the banknote can be brought back to the depositing and dispensing unit 10 side before it is determined that the entire banknote has passed a sensor 18*c* and a shift thereof into the storage and feed unit 20 is concluded.

Therefore, a canceling operation of a banknote jam can be performed solely on the shop side, thereby enabling to save time and labor for reporting to a representative of a banker (maintenance staff) and waiting for his maintenance call. The same mechanism is provided between the storage and feed unit 20 and the storage unit 30, and the returned banknote can be stored in an arbitrary stacker.

A flow of banknotes in the money handling apparatus according to the present embodiment is explained next with reference to FIGS. 4 to 8.

Figure 4:
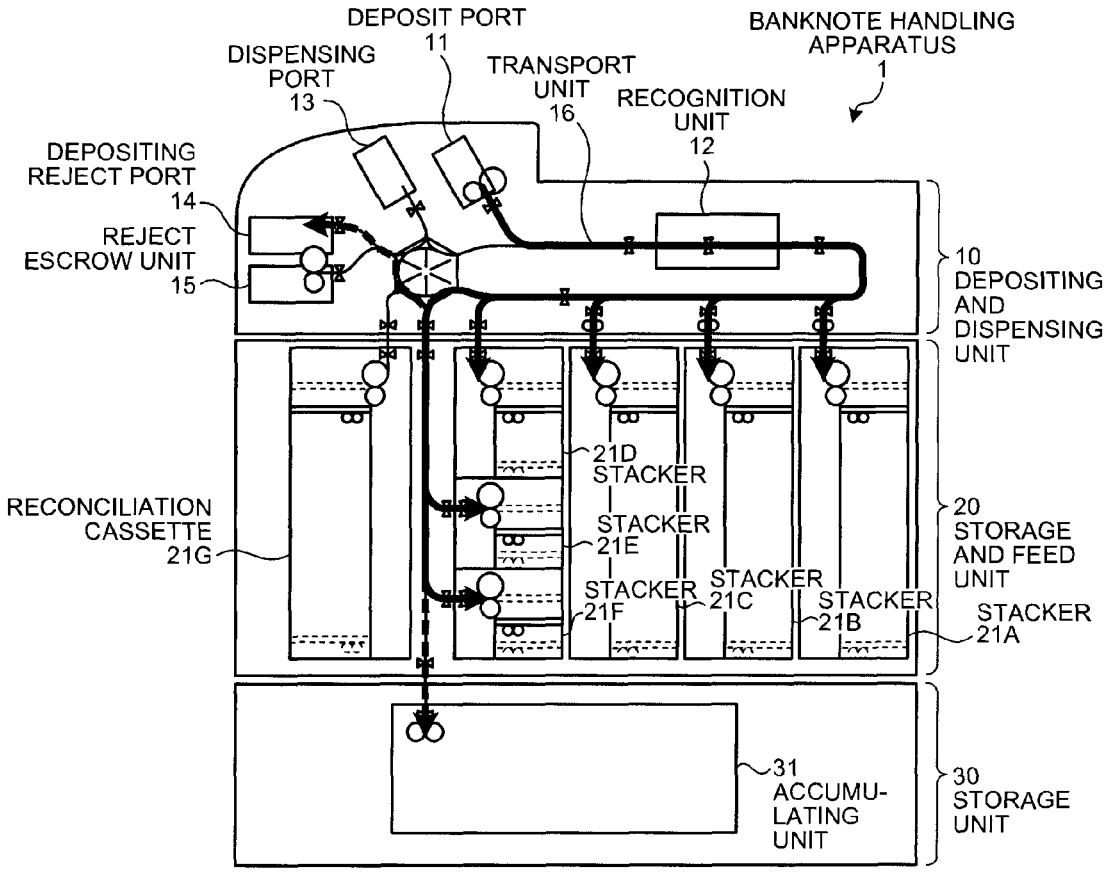
FIG. 4 is an explanatory diagram for explaining a flow of banknotes at the time of depositing.

A flow of banknotes at the time of depositing is explained first. FIG. 4 explains the flow of banknotes at the time of depositing. As shown in FIG. 4, at the time of depositing, a banknote fed and received from the deposit port 11 is allowed to pass the recognition unit 12 through the transport unit 16 and recognized. At this time, a transport destination is determined according to an identification result. For example, when the identification result is a 1-dollar banknote, the banknote is transported to the stacker 21A, and when the identification result is a 5-dollar banknote, the banknote is transported to the stacker 21B. The 10-dollar banknotes, 20-dollar banknotes, 50-dollar banknotes, and 100-dollar banknotes are transported in the same manner.

A flow of banknotes at the time of deposit return is explained next. Deposit return means returning of the banknotes performed in response to a rejecting operation of depositing performed when the deposited amount or denomination breakdown are not accepted, when the banknotes are temporarily stored in the stacker 21 in response to the depositing operation and the deposited amount and the denomination breakdown are confirmed and displayed by the operation terminal 110.

At the time of deposit return, when banknotes of any denomination from a 1-dollar banknote to a 100-dollar banknote are to be returned (dispensed), the banknotes are fed from the stacker 21 to the transport unit 16, and the fed banknotes are transported to the recognition unit 12 by the transport unit 16.

At this time, when a banknote is recognized as a banknote appropriate for dispensing, the banknote is transported to the dispensing port 13 by the transport unit 16, whereas when the banknote is recognized as a banknote inappropriate for dispensing (dispensing reject banknote), the banknote is transported to the reject escrow unit 15 by the transport unit 16.

The dispensing reject banknote temporarily held in the reject escrow unit 15 is transported to the stacker 21 as a storage source immediately, or transported to the stacker 21 as the storage source after return of denomination currently being made is complete. When the transaction is continuous, after a series of transactions finishes, the transport processing can be performed. Specifically, the return is performed when there is no transaction being made for a certain period of time.

The reason why the dispensing reject banknote is transported and returned to the stacker 21 as the storage source is that the reject escrow unit 15 is present not in the storage and feed unit 20, but in the depositing and dispensing unit 10 whose handling right is held by the shop, which does not have ownership of the dispensing reject banknote originally.

That is, it is not preferable that the dispensing reject banknote is held for a long time in the reject escrow unit 15, whose handling right is not held by the bank, which is the original holder of the dispensing reject banknote. Further, because the banknote, which should be present in the storage and feed unit 20, stays in the depositing and dispensing unit 10 whose handling right is held by the shop, the balance of the storage and feed unit 20 becomes uncertain.

Accordingly, in the present embodiment, the dispensing reject banknote is returned to the storage and feed unit 20 whose handling right is held by the bank as the original holder of the banknote as soon as possible, to secure consistency between the handling right of the part where the banknote is present and the ownership of the banknote, and return the balance of the storage and feed unit 20 to a defined state.

Therefore, when the reject escrow unit 15 is provided in the storage and feed unit 20, and if the number of banknotes fed from the stacker 21 and temporarily held in the reject escrow unit 15 is defined, return transport described above does not need to be performed, and the dispensing reject banknote can be held in the reject escrow unit 15.

Further, in the present embodiment, when the same banknote is recognized as the dispensing reject banknote repeatedly for a predetermined number of times (for example, three times), the banknote is stored in the accumulating unit 31 in the storage unit 30.

As a cause of the same banknote being recognized as the dispensing reject banknote repeatedly, a problem of a feed mechanism of the stacker 21 can be mentioned. When a plurality of banknotes are transported to the accumulating unit 31 in an overlapped state as the dispensing reject banknotes due to this problem, the number of dispensing reject banknotes stored in the accumulating unit 31 becomes unclear.

In the present embodiment, further, the number and the letter of the banknote recognized by the recognition unit 12 is registered in a memory unit 120 at a previous stage before the banknote is stored in the stacker 21, and the number and the letter of the banknote is also registered in the memory unit 120 at a stage in which the banknote is fed at the time of deposit return. The number and the letter at the time of storage and those at the time of feeding are compared with each other, thereby specifying the number of dispensing reject banknotes to be stored in the accumulating unit 31.

For example, when the numbers of the banknotes are registered in order of "0034", "0209", "1309", and "0020" in a storing stage in the stacker 21, if there is no problem in the feed mechanism of the stacker 21, the numbers should be registered in an order opposite to that at the time of storage such as "0020", "1309", "0209", and "0034" at the time of feeding. If a problem occurs in the feed mechanism and the numbers at the time of feeding are registered in order of "0020", "unclear", and "0034", banknotes with numbers "1309" and "0209" are missing as compared with the numbers at the time of storage. Therefore, it can be specified that the banknotes with these two numbers are overlapped on each other and recognized as "unclear". Thus, it can be regarded that two banknotes with numbers "1309" and "0209" are stored in the accumulating unit 31.

Figure 5:
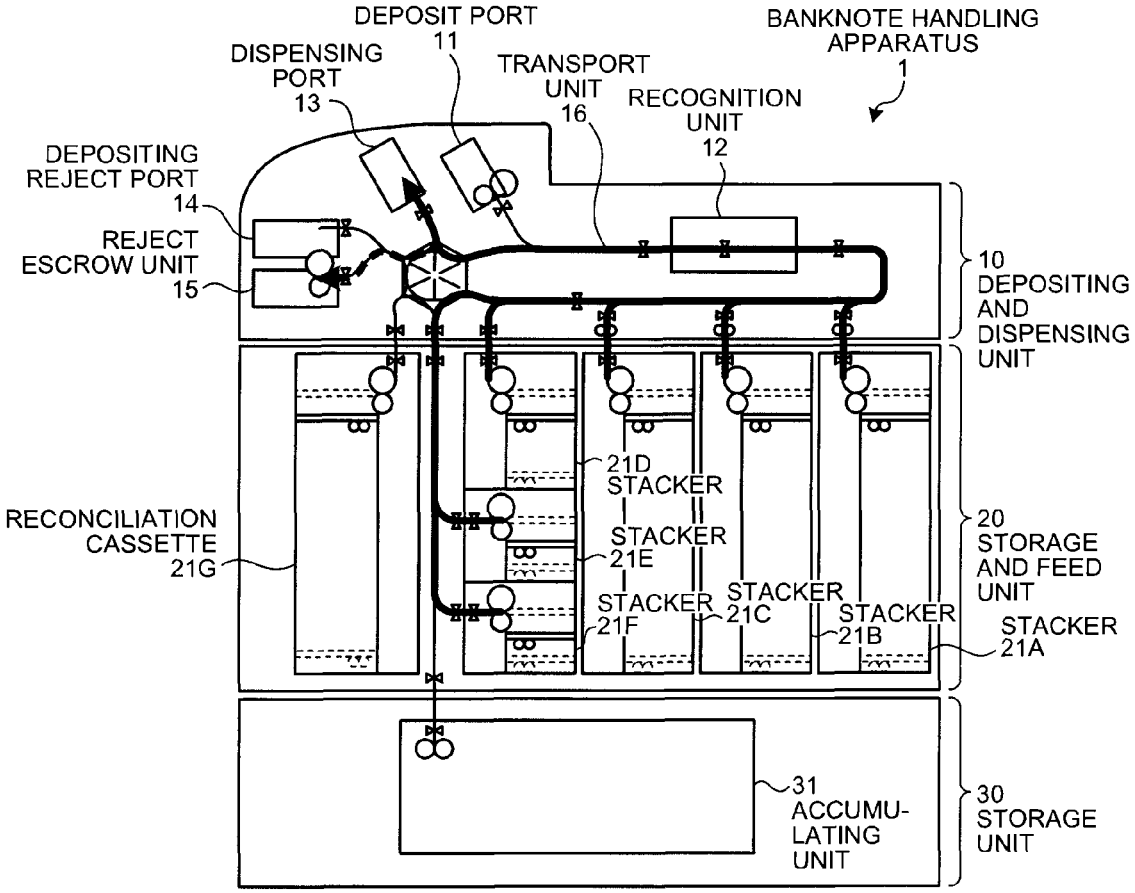
FIG. 5 is an explanatory diagram for explaining a flow of banknotes at the time of dispensing.

A flow of banknotes at the time of dispensing is explained next. FIG. 5 explains the flow of banknotes at the time of dispensing. As shown in FIG. 5, at the time of dispensing, in the case of dispensing a banknote of any denomination from a 1-dollar banknote to a 100-dollar banknote, the banknote is fed from the stacker 21 to the transport unit 16, and the fed banknote is transported to the recognition unit 12 by the transport unit 16.

At this time, when the banknote is recognized as a banknote appropriate for dispensing, the banknote is transported to the dispensing port 13 by the transport unit 16. On the other hand, when the banknote is recognized as a banknote inappropriate for dispensing (dispensing reject banknote), the banknote is transported to the reject escrow unit 15 by the transport unit 16. The dispensing reject banknote temporarily held in the reject escrow unit 15 is transported and returned as explained in the deposit return or transported to the accumulating unit 31.

A flow of banknotes at the time of replenishment to the deposit port is explained next. Replenishment to the deposit port means to load banknotes from the deposit port to replenish the stackers 21A to 21F with the banknotes for dispensing.

At the time of deposit replenishment, the banknotes for replenishment fed and received from the deposit port 11 are allowed to pass the recognition unit 12 by the transport unit 16, and recognized. At this time, the transport destination is determined according to the identification result.

For example, when the identification result is a 1-dollar banknote, the banknote is transported to the stacker 21A, and when the identification result is a 5-dollar banknote, the banknote is transported to the stacker 21B. The 10-dollar banknotes, 20-dollar banknotes, 50-dollar banknotes, and 100-dollar banknotes are transported in the same manner. On the other hand, when the identification result is for the depositing reject banknote, the banknote is ejected from the depositing reject port 14 by the transport unit 16, without being stored in any stacker 21. Even when the banknote for replenishment is recognized as a banknote appropriate for depositing, if the stacker 21 corresponding to the recognized denomination is in a nearly-full state or a completely full state, the banknote is returned from the dispensing port 13 by the transport unit 16.

A flow of banknotes at the time of cassette replenishment is explained next. Cassette replenishment means that the reconciliation cassette 21G is attached to the storage and feed unit 20 in a state of storing the banknotes, thereby replenishing the stackers 21A to 21F with the banknotes for dispensing.

At the time of cassette replenishment, banknotes are fed from the reconciliation cassette 21G to the stacker 21A, and the fed banknotes are transported to the recognition unit 12 by the transport unit 16. At this time, the transport destination is determined according to the identification result.

For example, when the identification result is a 1-dollar banknote, the banknote is transported to the stacker 21A, and when the identification result is a 5-dollar banknote, the banknote is transported to the stacker 21B. 10-dollar banknotes, 20-dollar banknotes, 50-dollar banknotes, and 100-dollar banknotes are transported in the same manner. On the other hand, when the identification result is for the depositing reject banknote, the banknote is ejected from the depositing reject port 14 by the transport unit 16, without being stored in any stacker 21. Even when the banknote for replenishment is recognized as a banknote appropriate for depositing, if the stacker 21 corresponding to the recognized denomination is in a nearly-full state or a completely full state, the banknote is returned from the dispensing port 13 by the transport unit 16. Alternatively, after the banknote is transported to the reject escrow unit 15 and held, the banknote can be transported to the reconciliation cassette 21G and stored therein.

Figure 6A:
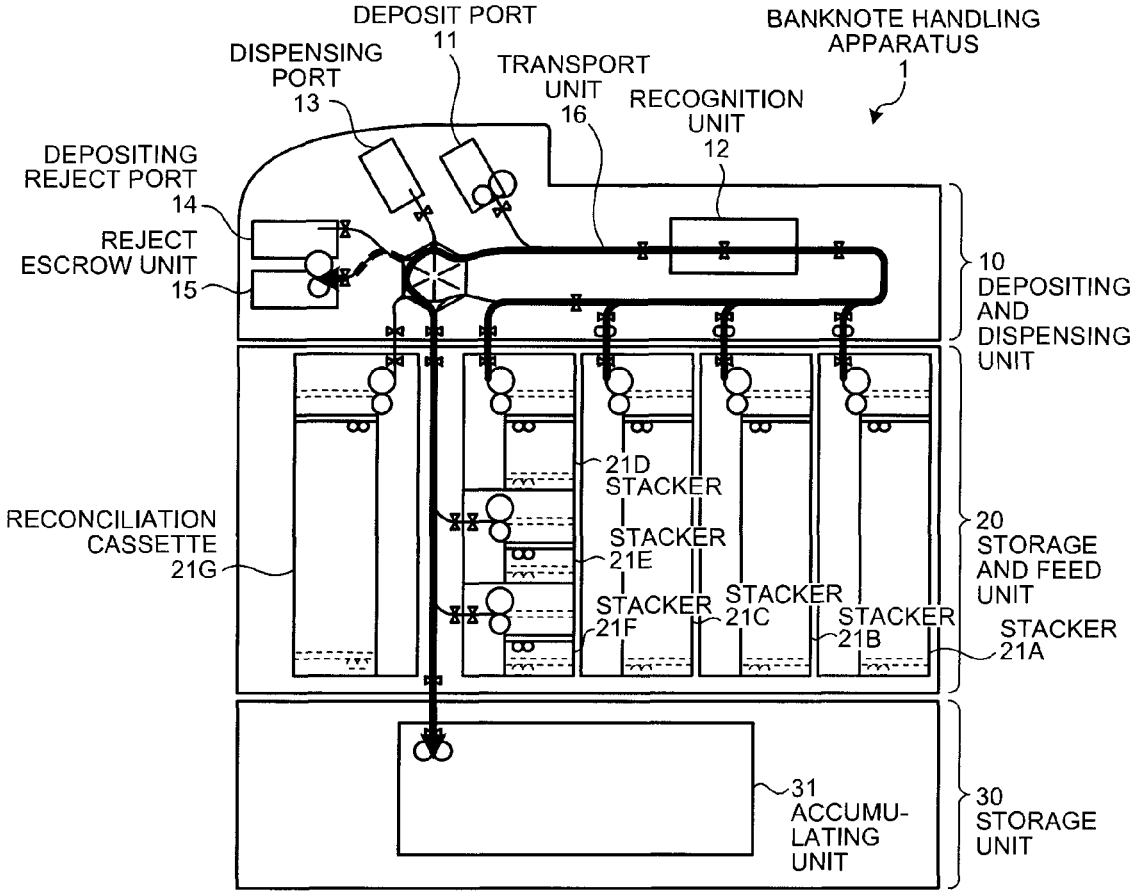
FIGS. 6A and 6B are explanatory diagrams for explaining a flow of banknotes at the time of delivery.
Figure 6B:
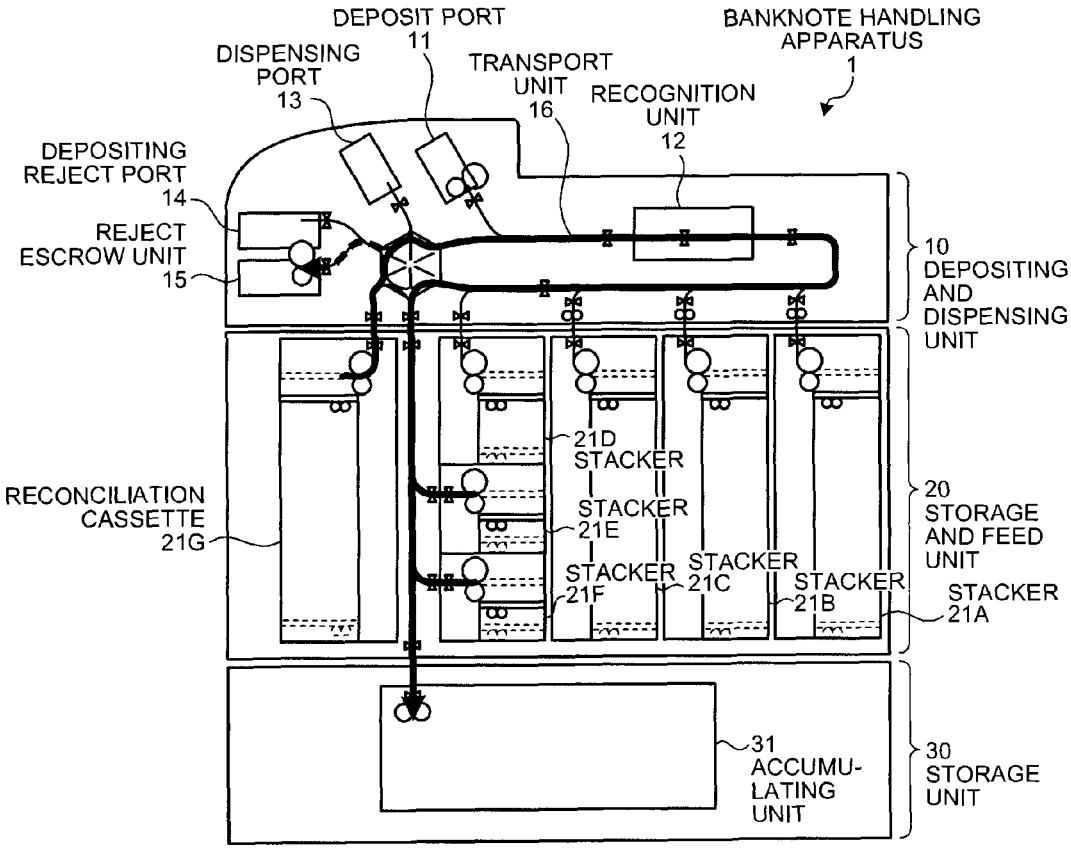

A flow of banknotes at the time of delivery is explained next. FIGS. 6A and 6B explain the flow of banknotes at the time of delivery. Delivery means to send banknotes stored in the stacker 21 over to the accumulating unit 31.

As shown in FIGS. 6A and 6B, at the time of delivery, an operation is different between stackers 21A to 21D for storing small denomination banknotes such as 1-dollar, 5-dollar, 10-dollar, and 20-dollar banknotes and stackers 21E and 21F for storing large denomination banknotes such as 50-dollar and 100-dollar banknotes in that whether to let them pass the reconciliation cassette 21G before being transported to the accumulating unit 31.

This difference is due to a layout of the stacker 21 in the money handling apparatus 1, and a delivery route is not different according to whether the banknote is the small denomination banknote or the large denomination banknote. That is, in the money handling apparatus 1 shown in FIG. 1, such a layout is adopted that a capacity of the stacker decreases as the denomination of the banknote becomes larger, because as the denomination of the banknote becomes larger, cases to be used as the banknote for dispensing decrease, and the number of banknotes reserved in the stacker 21 decreases.

The reason why the banknote is delivered via the reconciliation cassette 21G at the time of delivery to the stackers 21E and 21F is due to the layout such that the route for carrying the banknotes from the stackers 21E and 21F to the recognition unit 12 and the route for carrying the banknotes to the storage unit 30 after being recognized by the recognition unit 12 are overlapped. For example, by providing the stackers 21E and 21F to be adjacent to the depositing and dispensing unit 10, a restriction on the layout is removed and overlapping of the routes can be avoided.

At the time of delivery of the banknotes in the stackers 21A to 21D, as shown in FIG. 6A, the banknotes are fed from any one of stackers 21A to 21D to the transport unit 16, and the fed banknotes are transported to the recognition unit 12 by the transport unit 16.

At this time, when the banknote is recognized as the banknote appropriate for dispensing, the banknote is transported to the accumulating unit 31 by the transport unit 16. On the other hand, when the banknote is recognized as a banknote inappropriate for dispensing (dispensing reject banknote), the banknote is transported to the reject escrow unit 15 by the transport unit 16. The dispensing reject banknote temporarily held in the reject escrow unit 15 is transported and returned as explained in the deposit return or transported to the accumulating unit 31.

At the time of delivery of the banknotes in the stackers 21E and 21F, as shown in FIG. 6B, the banknotes are fed from the stacker 21E or 21F to the transport unit 16, and the fed banknotes are transported to the reconciliation cassette 21G by the transport unit 16. Thereafter, the banknotes are fed from the reconciliation cassette 21G to the transport unit 16, and the fed banknotes are transported to the recognition unit 12 by the transport unit 16.

At this time, when the banknote is recognized as a banknote appropriate for dispensing, the banknote is transported to the accumulating unit 31 by the transport unit 16. On the other hand, when the banknote is recognized as a banknote inappropriate for dispensing (dispensing reject banknote), the banknote is transported to the reject escrow unit 15 by the transport unit 16. The dispensing reject banknote temporarily held in the reject escrow unit 15 is transported and returned as explained in the deposit return or transported to the accumulating unit 31. In this case, because the route of the banknote transported to be held in the reject escrow unit 15 and the route of the banknote to be transported from the reconciliation cassette 21G to the recognition unit 12 are overlapped, feed of the banknote from the reconciliation cassette 21G is temporarily stopped when there is the dispensing reject banknote, to perform return transport or transport to the accumulating unit 31.

A flow of banknotes in an outward route for examination is explained. The examination means that when the number of banknotes stored in the stacker 21 (the balance of the storage and feed unit described later) becomes uncertain due to a banknote jam, the number of banknotes stored in the stacker 21 is examined. The examination includes an outward route for transporting the banknotes in the stacker 21 to the reconciliation cassette 21G and a returning route for transporting the banknotes transported to the reconciliation cassette 21G is transported again to the stacker 21, and the outward route is explained here.

For example, when the examination is performed in an ascending order from the stacker for small denomination banknotes, the banknotes are fed from the stacker 21A to the transport unit 16, and the fed banknotes are transported to the recognition unit 12 by the transport unit 16. At this time, when an identification result indicating that the banknote is a 1-dollar banknote is obtained, the banknote is transported to the reconciliation cassette 21G by the transport unit 16. On the other hand, when the banknote is recognized as a banknote inappropriate for dispensing (dispensing reject banknote), the banknote is transported to the reject escrow unit 15 by the transport unit 16. The dispensing reject banknote temporarily held in the reject escrow unit 15 is transported and returned as explained in the deposit return or transported to the accumulating unit 31.

Thus, the banknote is transported from the stacker 21A to the recognition unit 12 through the transport unit 16 and recognized until there is no banknote stored in the stacker 21A.

Figure 7:
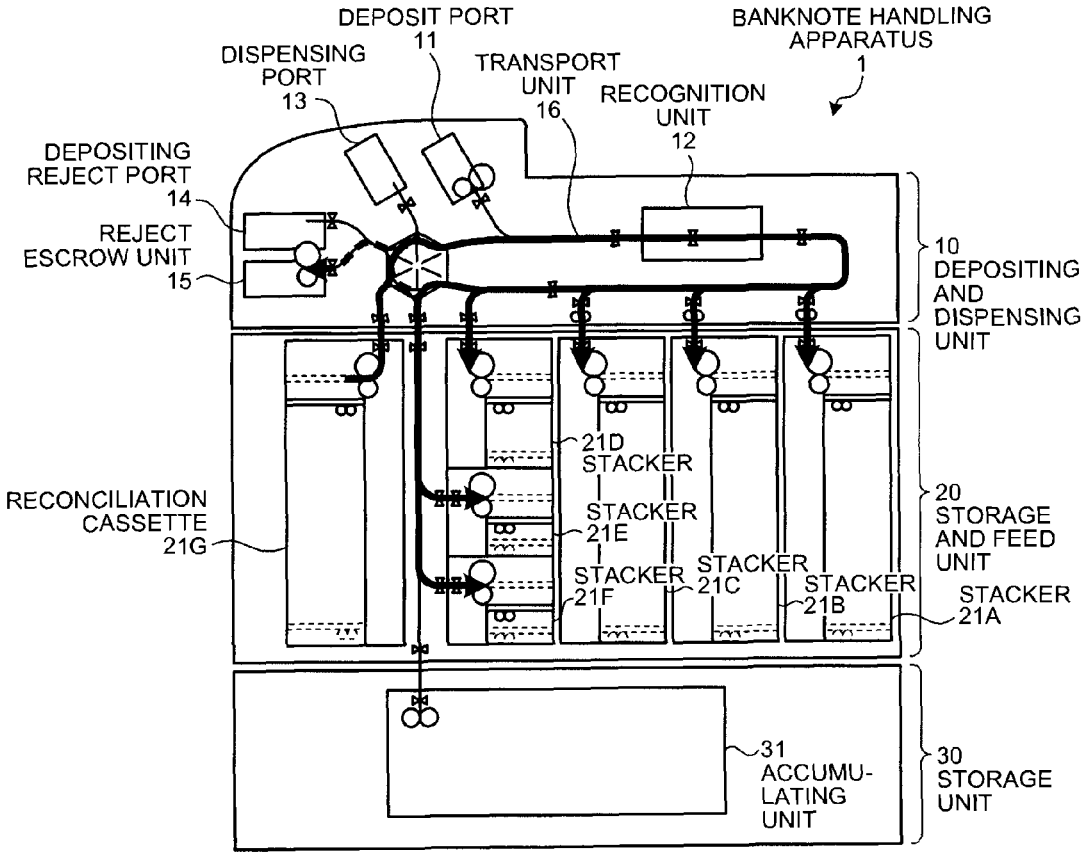
FIG. 7 is an explanatory diagram for explaining a flow of banknotes in a returning route from examination.

A flow of banknotes in a returning route from examination is explained next. FIG. 7 is an explanatory diagram for explaining the flow of banknotes in the returning route from examination. For example, in a case of the returning by which the banknote transported from the stacker 21A to the reconciliation cassette 21G is transported again into the stacker 21A, the banknote is fed from the reconciliation cassette 21G to the transport unit 16, and the fed banknote is transported to the recognition unit 12 by the transport unit 16.

At this time, as the banknote is recognized as a 1-dollar banknote in the outward route, when the banknote is recognized again as a 1-dollar banknote in the returning route, the 1-dollar banknote is transported to the stacker 21A by the transport unit 16. On the other hand, when it is recognized as the banknote inappropriate for dispensing (dispensing reject banknote), the banknote is transported to the reject escrow unit 15 by the transport unit 16. The dispensing reject banknote temporarily held in the reject escrow unit 15 is transported and returned as explained in the deposit return or transported to the accumulating unit 31.

Thus, the same operation is repeated until there is no 1-dollar banknote stored in the outward route in the reconciliation cassette 21G, and at a point in time when there is no 1-dollar banknote in the reconciliation cassette 21G, the examination of the banknotes stored in the stacker 21A is complete. When the examination of the banknotes stored in the stacker 21A is complete for the outward route and the returning route, the examination of the banknotes stored in the stacker 21B is started for the outward route and the returning route, and the examination is continued repeatedly until the examination of the stacker 21F finishes.

In this manner, the recognition unit 12 recognizes whether the banknote coincides with the denomination in the stacker 21 in the outward route for transporting the banknote from the stacker 21 to the reconciliation cassette 21G, and in the returning route from the reconciliation cassette 21G to the stacker 21, the recognition unit 12 recognizes again whether the banknote coincides with the denomination in the stacker 21. Accordingly, even if the number of banknotes stored in the stacker 21 becomes uncertain due to a banknote jam (banknote clogging) or the like, accurate number of banknotes stored can be re-specified.

In the present embodiment, identification is performed in both the outward route and the returning route. However, one of the identification processing performed in the outward route and the returning route can be omitted. In the present embodiment, further, the examination can be performed only for the stacker 21, in which the balance becomes uncertain due to an occurrence of a banknote jam or the like. It is also possible that only a specified stacker 21 is examined.

A flow of banknotes at the time of coordination and counting is explained next. Coordination and counting mean that counting is performed for coordinating the amount of cash in hand or the number of banknotes by denomination held by a shop operator. For example, coordination is performed by extracting a specified number of banknotes of a specified denomination from banknotes in which plural denominations are mixed together.

For example, when coordination is performed by extracting thirty 10-dollar banknotes from one hundred banknotes of mixed denominations, banknotes of mixed denominations placed in the deposit port 11 are sequentially fed, and the banknotes received at the deposit port 11 are allowed to pass through the recognition unit 12 and recognized.

At this time, when the recognition unit 12 recognizes that the banknote is not a 10-dollar banknote, for example, when it is a banknote of other denominations or a banknote off the subject such as a reject banknote, the banknote off the subject is transported to the depositing reject port 14 by the transport unit 16.

On the other hand, when the recognition unit 12 recognizes the banknote as a 10-dollar banknote, that is, the banknote is to be coordinated, the 10-dollar banknote is transported to the dispensing port 13 by the transport unit 16. When the number of 10-dollar banknotes to be coordinated recognized by the recognition unit 12 reaches thirty sheets, 10-dollar banknotes are transported again to the dispensing port 13 after it is detected that thirty 10-dollar banknotes ejected from the dispensing port 13 have been taken out. That is, processing for transporting 10-dollar banknotes of thirty sheets each is repeated until there is no banknote placed in the deposit port 11.

In this manner, while banknotes of mixed denominations are received from the deposit port 11 and thirty 10-dollar banknotes to be coordinated are ejected from the dispensing port 13, banknotes off the subject are ejected from the depositing reject port 14.

Banknotes to be coordinated are transported to the dispensing port 13, and the banknotes off the subject are transported to the depositing reject port 14. However, the banknotes off the subject can be transported to the dispensing port 13, and the banknotes to be coordinated can be transported to the depositing reject port 14.

When banknotes exceeding the capacity are ejected to the dispensing port 13, infeed of banknotes in the deposit port 11 can be temporarily suspended until removing of the banknotes ejected to the dispensing port 13 is detected, or the banknotes can be ejected from the depositing reject port 14 instead of the dispensing port 13.

At the time of coordination and counting, the dispensing port 13 and the depositing reject port 14 can be used as an ejection port of the banknotes to be coordinated, and banknotes off the subject can be transported to the reject escrow unit 15 and the reconciliation cassette 21G. At this time, banknotes of single denomination can be transported to the dispensing port 13 and the depositing reject port 14, or banknotes of plural denominations can be transported thereto.

While an example of coordinating banknotes of various denominations has been described, the application of the coordination method is not limited to the denomination of banknotes, and coordination and counting can be performed for each item of kinds, fit or unfit, front or back, large or small denomination banknote, banknotes of own country or foreign countries, specific banknote or other banknotes, normal banknote or other banknotes (including counterfeit banknotes and questionable banknotes).

A flow of banknotes at the time of depositing and dispensing is explained next. Depositing and dispensing corresponds to "first change preparing process" (see FIG. 17) described later, and means that for example when deposit of sales proceeds is accepted, a part of banknotes by denomination to be dispensed as change fund, which can be supplied from banknotes deposited as the sales proceeds, is directly dispensed without storing in the stacker 21.

The banknotes fed and received at the deposit port 11 are allowed to pass through the recognition unit 12 by the transport unit 16 and recognized. When the number of dispensed banknotes of the recognized denomination is less than a set number of banknotes of the denomination in a dispensing breakdown constituting the change fund, the banknotes are continuously dispensed in the dispensing port 13. Whereas, when the number of dispensed banknotes of the recognized denomination reaches the set number of banknotes, the banknotes are transported to the stacker 21 corresponding to the denomination.

When the banknotes exceeding the capacity are ejected to the dispensing port 13, infeed of banknotes in the deposit port 11 can be temporarily suspended until removing of the banknotes ejected to the dispensing port 13 is detected, or the change fund can be ejected from the depositing reject port 14 instead of the dispensing port 13.

A flow of banknotes at the time of ATM fit dispensing is explained next. The ATM fit dispensing means that the banknote with a good condition for being used by an ATM in the shop (ATM fit note) is dispensed. That is, because ATMs are expected to operate unattended without having various troubles such as a banknote jam, there are high needs for banknotes with a good condition to be used among genuine banknotes.

At the time of ATM fit dispensing, the banknote is fed from the stacker 21 to the transport unit 16, and the fed banknote is transported to the recognition unit 12 by the transport unit 16.

At this time, only banknotes recognized as a genuine banknote and recognized that a quality level set according to quality breakdowns such as stain and wrinkle is better than a specified condition are transported to the dispensing port 13. On the other hand, when the quality level is not better than the specified condition, even if it is a genuine banknote, the banknote is transported to the reconciliation cassette 21G. Among these banknotes, the banknotes stored in the reconciliation cassette 21G are sequentially fed out and transported to the recognition unit 12 after the ATM fit dispensing and transported to the stacker 21 corresponding to the denomination recognized by the recognition unit 12.

Figure 8:
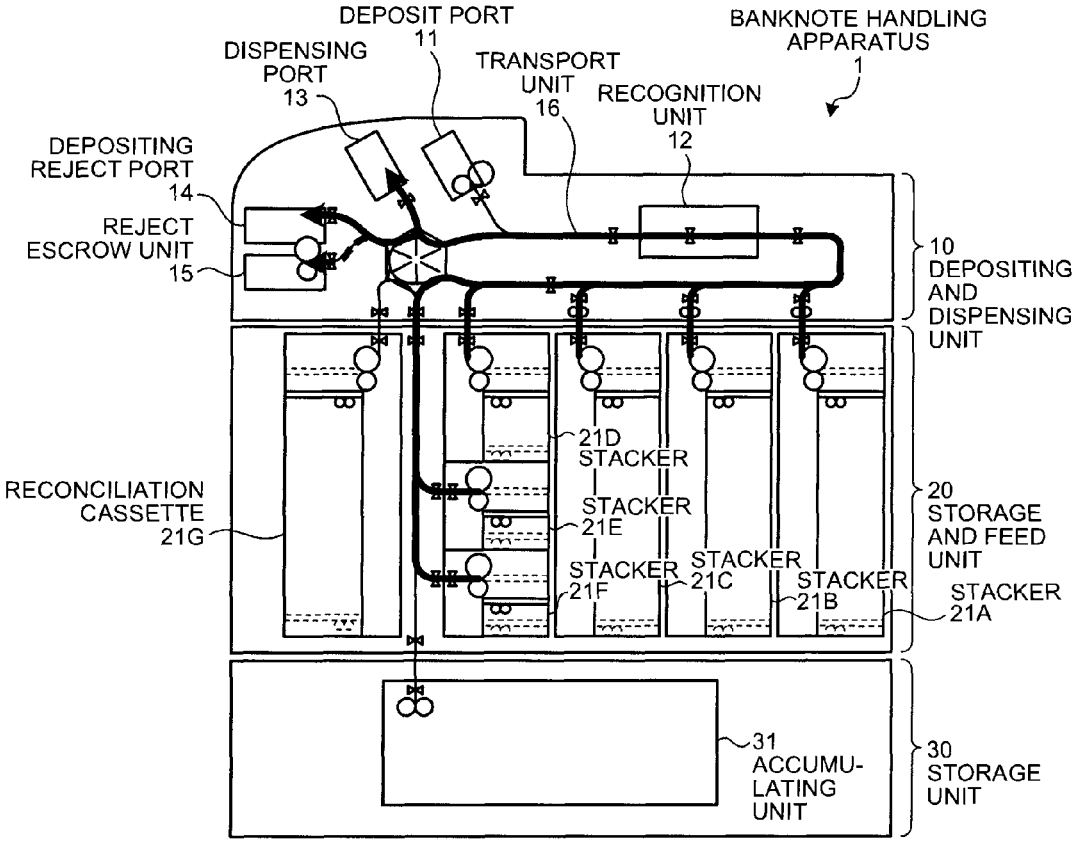
FIG. 8 is an explanatory diagram for explaining a flow of banknotes at the time of dispensing in continuous transactions.

A flow of banknotes at the time of dispensing in continuous transactions is explained next. FIG. 8 is an explanatory diagram for explaining the flow of banknotes at the time of dispensing in continuous transactions. The dispensing in continuous transactions corresponds to "second dispensing process" (see FIG. 18) described later, and means that when dispensing is continuously performed for a plurality of dispensing transactions, the banknotes are dispensed, changing over the dispensing port 13 or the depositing reject port 14 as the transport destination for each dispensing transaction.

As shown in FIG. 8, at the time of dispensing in continuous transactions, in the case of dispensing the banknote of any denomination from a 1-dollar banknote to a 100-dollar banknote, the banknote is fed from the stacker 21 to the transport unit 16, and the fed banknote is transported to the recognition unit 12 by the transport unit 16.

At this time, when the banknote is recognized as a banknote appropriate for dispensing, the banknote is transported to either the dispensing port 13 or the depositing reject port 14, which is the ejection port specified as the transport destination in the dispensing transaction, by the transport unit 16. On the other hand, when the banknote is recognized as a banknote inappropriate for dispensing (dispensing reject banknote), the banknote is transported to the reject escrow unit 15 by the transport unit 16. The dispensing reject banknote temporarily held in the reject escrow unit 15 is transported and returned as explained in the deposit return or transported to the accumulating unit 31.

Figure 9:
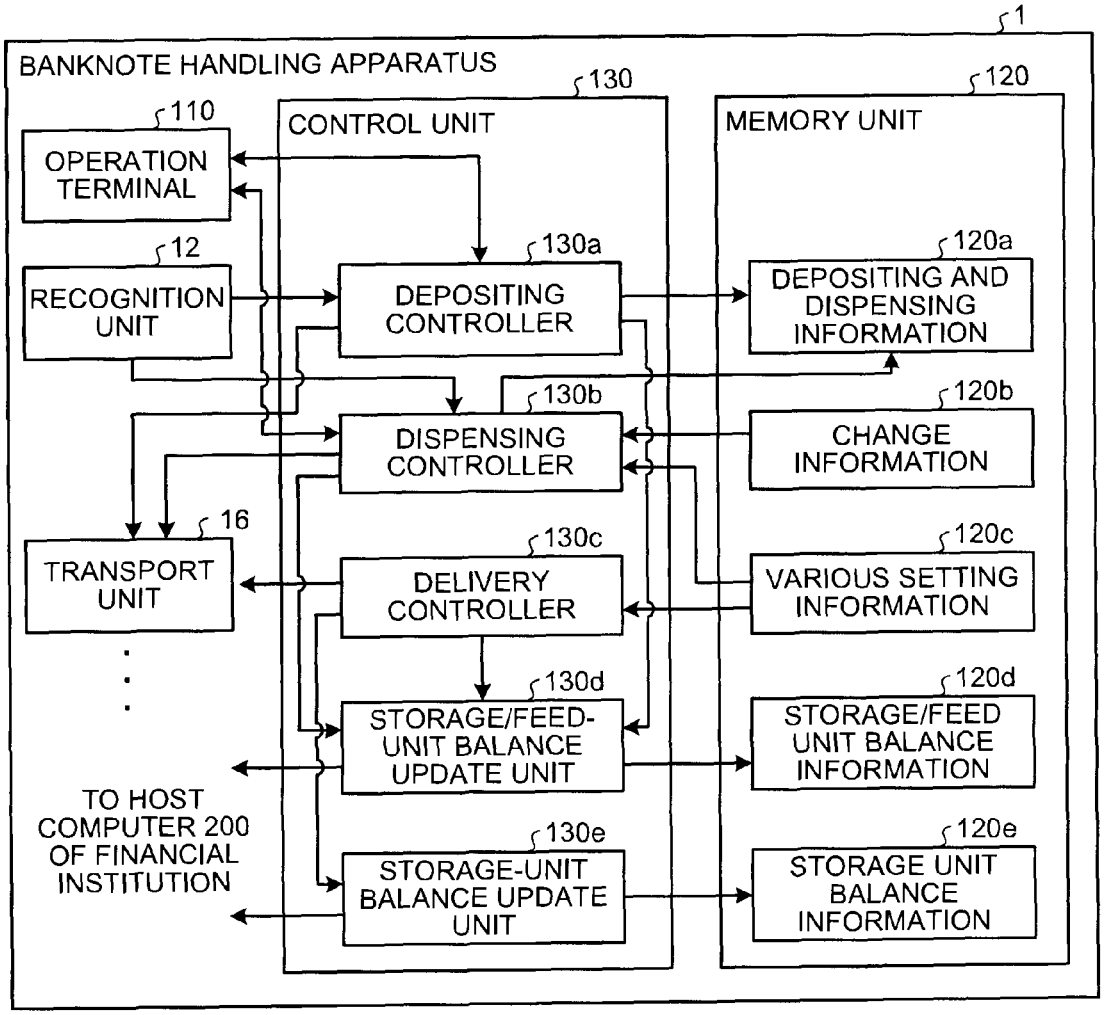
FIG. 9 is a block diagram of a functional configuration of the money handling apparatus according to the embodiment.

A functional configuration of the money handling apparatus according to the present embodiment is explained next. FIG. 9 is a block diagram of the functional configuration of the money handling apparatus according to the present embodiment. As shown in FIG. 9, the money handling apparatus 1 includes the operation terminal 110, the memory unit 120, and a controller 130.

The operation terminal 110 is basically operated by an authorized personnel of the shop such as a shop operator or a shop manager. However, the operation terminal 110 can be operated by a bank personnel or a security personnel, for a specific application such as a case of unlocking a vault in the storage and feed unit 20 or the storage unit 30.

Figure 10:
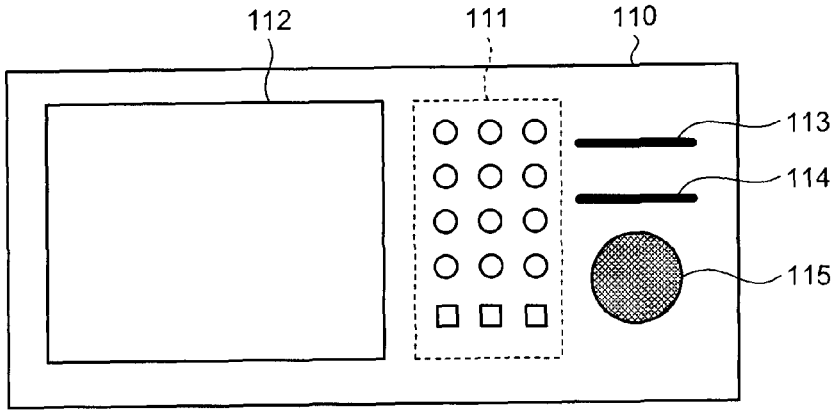
FIG. 10 is a plan view of an appearance of an operation terminal according to the embodiment.

The operation terminal 110 includes, as shown in FIG. 10, an instruction receiving unit 111, a display unit 112, a card reader 113, a printing unit 114, and an informing unit 115.

The instruction receiving unit 111 is an operation key group that receives an instruction input, and receives, for example, an operation for inputting or selecting a content of the depositing transaction or the dispensing transaction, an operation for selecting approval or rejection of settled depositing, an operation for inputting or selecting a deposited amount, an operation for selecting use of a transport destination changeover function in one transaction or continuous transactions, or an operation for selecting use of a function for preparing change fund from the sales proceeds.

The display unit 112 is a display device for displaying predetermined information, and for example, displays the deposited amount and the denomination breakdown thereof for confirmation at the time of deposit processing, and displays information about the banknotes ejected in the dispensing port 13 or the depositing reject port 14 or information about the dispensing transaction at the time of dispensing processing. In FIG. 10, the instruction receiving unit 111 and the display unit 112 are individually configured; however, these units can be integrally configured as a display input unit.

The card reader 113 reads information recorded on a card, and reads authentication information such as an ID and a password from a card provided beforehand to the authorized personnel of the shop as preprocessing for the authorized personnel of the shop to perform the depositing and dispensing processing or reads the authentication information from a card provided beforehand to a maintenance personnel or a guard as the preprocessing for the maintenance personnel or the guard to unlock the vault in the storage and feed unit 20 or the storage unit 30. The authentication for recognizing the authorized personnel of the shop, a bank personnel, or a security personnel do not need to be card authentication, and password authentication can be performed instead via the instruction receiving unit 111. Alternatively, authentication using biological information such as a face or fingerprints can be used.

The printing unit 114 is a printing device such as a printer, and for example, prints out the amount of the change fund or the number of banknotes by denomination as a change preparation receipt at the time of creating the change fund. Also at the time of depositing, dispensing, delivery, or collection, the printing unit 114 can print information about various breakdowns such as the amount handled, the number of banknotes by denomination, the transaction date and time, and an operator ID as a receipt.

The informing unit 115 is a speaker or a lamp that outputs speech or light, and for example, when a banknote jam occurs, phonetically outputs a speech message or a warning tone, or blinks the lamp.

The memory unit 120 is a memory device such as a non-volatile memory that stores data and a program required for various types of processing performed by the control unit 130, and stores, for example, depositing and dispensing information 120*a*, change information 120*b*, various setting information 120*c*, storage/feed unit balance information 120*d*, and storage unit balance information 120*e*, as well as the number and the letter at the time of storage in the stacker 21 and a printing format of the change preparation receipt.

The depositing and dispensing information 120*a* is log information about the deposit processing and the dispensing processing. For example, in the case of the deposit processing, information such as ID of a cash register, ID of an operator, depositing transaction time, transaction type, deposited amount, and denomination breakdown thereof is registered after the deposit processing. In the case of the dispensing process (including change preparation process), information such as an ID of a cash register, ID of an operator, dispensing transaction time, transaction type, dispensing amount, and dispensing breakdown is registered after the dispensing processing.

The change information 120*b* is information about dispensing breakdown indicating the amount to be dispensed as the change fund and the number of banknotes by denomination, and for example, the dispensing breakdown (for example, breakdown indicating 1-dollar banknotes:40, 5-dollar banknotes:40, 10-dollar banknotes:40, 20-dollar banknotes:20, and 50-dollar banknotes:10) of the change fund for each cash register in the shop is registered according to an operation input using a higher-level device or the instruction receiving unit 111 communication-connected to the money handling apparatus 1.

The various setting information 120*c* includes pieces of setting information in the money handling apparatus 1, and for example, a condition for performing delivery control for transporting a banknote from the stacker 21 to the accumulating unit 31 (for example, setting of an upper limit or optimum value of the number of banknotes stored) is set and registered according to the operation input by the higher-level device or the instruction receiving unit 111 communication-connected to the money handling apparatus 1. Setting regarding which of the dispensing port 13 and the depositing reject port 14 is given priority as a transport destination of the dispensed banknotes is also registered.

The storage/feed unit balance information 120*d* expresses the balance, which is an amount to be stored and the number of banknotes by denomination in the stacker 21 of the storage and feed unit 20. In the present embodiment, because the stacker 21 is allocated for each denomination, the number of banknotes stored in each stacker 21 becomes equivalent to the number of banknotes by denomination.

The storage unit balance information 120*e* expresses the balance, which is the amount to be stored and the number of banknotes by denomination in the accumulating unit 31 of the storage unit 30.

The memory unit 120 stores information about the handling right of the depositing and dispensing unit 10, the storage and feed unit 20, and the storage unit 30. Specifically, the memory unit 120 stores the handling right associating the authentication information such as an ID or a password provided beforehand to a shop operator, a shop manager, a maintenance personnel, and a specified person for collection with an operation right and an unlocking right given to the authentication information.

The operation right is for performing processing corresponding to an operation made by an operator, and includes, for example, an access right to the storage and feed unit balance enabling to access and view the balance of the storage and feed unit 20 and an access right to the storage unit balance enabling to access and view the balance of the storage unit 30, as well as a deposit right enabling to perform the deposit processing for receiving banknotes, a dispensing right enabling to perform the dispensing processing for ejecting the banknotes, and a delivery right enabling to perform the delivery processing for delivering the banknotes from the storage and feed unit 20 to the storage unit 30.

For example, because the shop operator and the shop manager belong to the shop, the depositing right and the dispensing right are given, and because a maintenance personnel of a bank belongs to the bank and the cash in the storage unit is in the possession of the bank, the delivery right and the balance access right of both the storage and feed unit and the storage unit are given. Because the specified person for collection belongs to a security company, only the unlocking right is required, and the operation right does not need to be provided. However, only the balance access right of the storage unit can be given for confirming the collected amount. Various operation rights can be set arbitrarily by the operation terminal 110 or a higher-level device. For example, many operation rights can be given to a senior authorized person for the operations belonging to the same party concerned such as the shop operator and the shop manager.

In the money handling apparatus 1 according to the present embodiment, the authentication information about the operator is input via the operation terminal 110 before performing the deposit processing, dispensing processing, delivery processing, and balance access processing, and the operation right stored in the memory unit 120 in association with the authentication information is confirmed.

At this time, the money handling apparatus 1 determines whether the right (depositing right, dispensing right, delivery right, or access right) corresponding to the processing requested by the operator is given to the operation right corresponding to the authentication information whose input has been received, and when the right corresponding to the processing requested by the operator is given, the money handling apparatus 1 proceeds to an execution stage of the processing. Specifically, the processing corresponding to the right of the operator is displayed on the display unit 112, thereby enabling to select the processing.

On the other hand, when the input authentication information is not registered in the memory unit 120, or even when the authentication information is registered in the memory unit 120, if the right corresponding to the processing requested by the operator is not given, the processing is not performed. In the former case, there is a high possibility that the operator is not any one of the three parties concerned, and thus a warning can be issued as an illegitimate operation by a third party.

In this manner, the operation right is given to the authentication information given to the operator who operates the depositing and dispensing unit 10, or at least one of the storage and feed unit 20 and the storage unit 30, and it is determined whether the operation right of the processing requested by the operated is included in the operation right corresponding to the authentication information input by the operator. Accordingly, the processing requested by the operator can be performed only when the operation right is given to the operator.

In the present embodiment, an example in which the deposit right and the delivery right are exclusively given has been described. However, the operation rights of the deposit right and the delivery right can be given to the same person, and a person who has only the deposit right, a person who has only the delivery right, and a person who has both the deposit right and the delivery right can be arbitrarily set.

The unlocking right relates to unlock of the inside of the money handling apparatus 1, and for example, includes an unlocking right of the depositing and dispensing unit 10, an unlocking right of the storage and feed unit 20, and an unlocking right of the storage unit 30.

For example, a shop operator and a shop manager are given with the unlocking right of the depositing and dispensing unit 10, a maintenance personnel of the bank is given with the unlocking right of the storage and feed unit 20 and the storage unit 30, and a specified person for collection is given with the unlocking right of the storage unit 30.

In the money handling apparatus 1 according to the present embodiment, before unlocking the depositing and dispensing unit 10, the storage and feed unit 20, or the storage unit 30, the authentication information about the operator is input via the operation terminal 110, to confirm the unlocking right stored in the memory unit 120 in association with the authentication information.

At this time, in the money handling apparatus 1, it is determined whether the unlocking right corresponding to a part (the depositing and dispensing unit 10, the storage and feed unit 20, or the storage unit 30) requested by the operator is given to the unlocking right corresponding to the authentication information whose input has been received. If the unlocking right corresponding to the part requested by the operator is given, a lock (for example, an electronic lock) of the part is unlocked. Accordingly, in the present embodiment, unlocking of the part can be performed only when the unlocking right is given to the part whose unlocking is requested by the operator.

In the present embodiment, a case that the lock is electronically unlocked has been explained. However, for example, a key corresponding to the respective parts is provided beforehand, and unlocking by a key operation can be mechanically performed, or both of mechanical unlocking and electronic unlocking can be performed.

In the present embodiment, an example in which the unlocking right of the depositing and dispensing unit 10 and the unlocking right of the storage and feed unit 20 and the storage unit 30 are exclusively given has been described. However, the unlocking right of the depositing and dispensing unit 10, the storage and feed unit 20, and the storage unit 30 can be given to the same person, and a person who has only the unlocking right of the depositing and dispensing unit 10, a person who has only the unlocking right of the storage and feed unit 20, a person who has two unlocking rights of the three parts, and a person who has unlocking rights of the three parts can be arbitrarily set.

The control unit 130 controls the entire money handling apparatus 1, and includes a depositing controller 130*a*, a dispensing controller 130*b*, a delivery controller 130*c*, a storage/feed-unit balance update unit 130*d*, and a storage-unit balance update unit 130*e*. In practice, the control unit 130 stores a program corresponding to these functional units in a ROM or a nonvolatile memory (not shown), and these programs are loaded on a CPU and executed so that the depositing controller 130*a*, the dispensing controller 130*b*, the delivery controller 130*c*, the storage/feed-unit balance update unit 130*d*, and the storage-unit balance update unit 130*e* performs a process corresponding thereto.

The depositing controller 130*a* performs control associated with the deposit processing. Details thereof will be described later with reference to FIG. 11. As an outline, the depositing controller 130*a* controls the transport unit 16 to transport the banknote received in the apparatus to the recognition unit 12 when an operation required as preprocessing of the deposit processing, for example, an input of the authentication information and a loading operation of the banknotes are received as a depositing operation. At this time, when the received banknotes is recognized as a banknote appropriate for deposit by the recognition unit 12, the received banknote is transported to the stacker 21 corresponding to the recognized denomination by the transport unit 16, and the number of banknotes stored is counted by denomination. When the received banknote is recognized as a banknote inappropriate for depositing, the received banknote is transported to the depositing reject port 14 by the transport unit 16. The series of operations is repeated until there is no banknote in the deposit port 11, and the number of stored banknotes by denomination at a point in time when there is no banknote is confirmed and displayed on the operation terminal 110 as the deposited amount and denomination breakdown thereof.

The dispensing controller 130*b* performs control associated with the dispensing processing. Details thereof will be described later with reference to FIGS. 12 to 18. As an outline, by performing transport control for controlling the transport unit 16 to transport the dispensed banknotes to the depositing reject port 14, even if dispensing becomes impossible at the dispensing port 13 due to a banknote jam, the depositing reject port 14 is used as a bypass. Accordingly, it can be prevented that the efficiency of the dispensing processing decreases.

Further, when the dispensing processing is performed for a plurality of dispensing transactions, the dispensing controller 130*b* changes over the dispensing port 13 and the depositing reject port 14 as the transport destination for each dispensing transaction, to control the transport unit 16 to transport the banknotes fed from the stacker 21.

For example, when there are cash registers NO. 1 to NO. 7 in the shop, an operation for preparing the change fund for the seven registers for the next business day is performed at the time of a closing operation after close of business of the shop.

Under such a circumstance, when the change fund of registers NO. 1 to NO. 7 is transported to the dispensing port 13, even after completion of transport of the change fund for register NO. 1, transport of the change fund for register NO. 2 cannot be started until the change fund for register NO. 1 is pulled out from the dispensing port 13. Therefore, a waiting time for a removing operation of the change fund for register NO. 1 becomes a lost time. Further, the number of times of the removing operation of the change fund affecting the dispensing of the next change fund becomes six times, and thus the waiting time becomes long inevitably.

On the other hand, in the present embodiment, immediately after transport of the change fund for register NO. 1 to the dispensing port 13 finishes, the transport unit 16 is controlled to transport the change fund for register NO. 2 to the depositing reject port 14. Therefore, if the removing operation of the change fund for register NO. 1 is performed until dispensing of the change fund for register NO. 2 finishes, the waiting time can be made zero. Even if the waiting time does not become zero, the number of times of the removing operation of the change fund becomes about half, thereby enabling to reduce an absolute value of the waiting time for the removing operation.

In the present embodiment, therefore, the waiting time for the removing operation of the dispensed banknotes can be reduced to at least half or up to zero, thereby enabling to improve the efficiency of the dispensing processing rapidly.

The delivery controller 130*c* controls the transport unit 16 to deliver banknotes stored in the stacker 21 to the accumulating unit 31 when a predetermined condition is satisfied. For example, when a host computer 200 managed by a bank inputs a delivery instruction, when a representative of the bank such as a maintenance personnel inputs an instruction using the instruction receiving unit 111, or when the number of banknotes stored in the stacker 21 reaches the upper limit, the delivery controller 130*c* controls the transport unit 16 to transport the banknotes for a specified amount from the stacker 21 to the accumulating unit 31 or controls the transport unit 16 to transport the banknotes of a specified denomination for a specified number from the stacker 21 to the accumulating unit 31.

The delivery controller 130*c* can perform the delivery control completely automatically if the amount accumulated in the stacker 21 and a set value of time are registered in the memory unit 120 as the various setting information 120*c*. For example, when a condition relating to the amount accumulated in the stacker 21 is to be set, an upper limit and an optimum amount of the number of banknotes stored can be set with respect to the respective stackers 21 or the upper limit and the optimum amount can be set with respect to the entire amount in the stacker 21, or an upper limit and an optimum value of the quantity of actually accumulated banknotes (the downward degree of the stage in the embodiment) can be set regardless of the number of banknotes stored.

According to the former case, it can be prevented that the banknotes exceeding the amount set by the bank remain in the storage and feed unit 20. According to the latter case, even when the stored banknotes are wrinkled or contain moisture to become bulky as compared to the same number of banknotes having no abnormality, such an abnormal condition can be detected to enable delivery of the banknotes.

The storage/feed-unit balance update unit 130*d* updates the storage/feed unit balance information 120*d* stored in the memory unit 120. Specifically, when the deposit processing is performed by the depositing controller 130*a*, the storage/feed-unit balance update unit 130*d* adds and updates the deposited amount and the denomination breakdown, respectively, to the amount and the number of banknotes by denomination stored in the storage and feed unit 20. When the dispensing processing is performed by the dispensing controller 130*b*, the storage/feed-unit balance update unit 130*d* subtracts and updates the dispensing amount and the denomination breakdown, respectively, from the amount and the number of banknotes by denomination stored in the storage and feed unit 20. When the delivery processing is performed by the delivery controller 130*c*, the storage/feed-unit balance update unit 130*d* subtracts and updates the delivery amount and the denomination breakdown, respectively, from the amount and the number of banknotes by denomination stored in the storage and feed unit 20.

The storage-unit balance update unit 130*e* updates the storage unit balance information 120*e* stored in the memory unit 120. Specifically, when the delivery processing is performed by the delivery controller 130*c*, the storage-unit balance update unit 130*e* adds and updates the delivery amount and the denomination breakdown to the balance of the storage unit 30.

Figure 11:
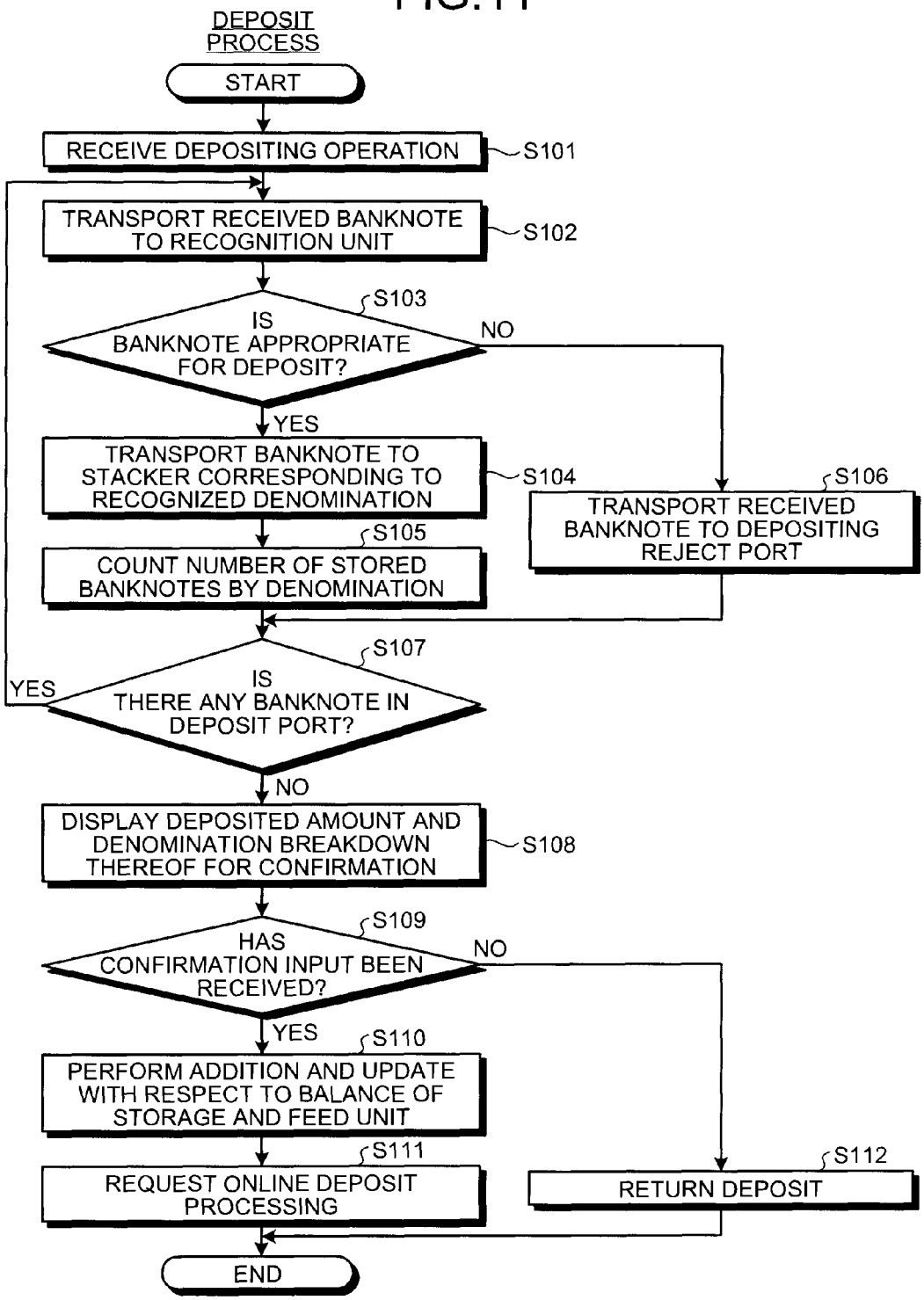
FIG. 11 is a flowchart of a depositing process procedure according to the embodiment.

The deposit processing according to the present embodiment is explained next. FIG. 11 is a flowchart of a depositing process procedure according to the present embodiment.

As shown in FIG. 11, when an operation required as the preprocessing of the deposit processing, for example, an input of the authentication information and a loading operation of banknotes are received as the depositing operation (Step S101), the depositing controller 130*a* controls the transport unit 16 to transport the banknotes received in the apparatus to the recognition unit 12 (Step S102).

At this time, when the recognition unit 12 recognizes that the received banknote is a banknote appropriate for deposit (Yes at Step S103), the depositing controller 130*a* controls the transport unit 16 to transport the received banknote to the stacker 21 corresponding to the recognized denomination, and counts the number of stored banknotes by denomination (Steps S104 and S105).

On the other hand, when the recognition unit 12 recognizes that the received banknote is a banknote inappropriate for deposit (No at Step S103), the depositing controller 130*a* controls the transport unit 16 to transport the received banknote to the depositing reject port 14 (Step S106).

The depositing controller 130*a* repeatedly performs the process from Steps S102 to S106 until there is no loaded banknote in the deposit port 11 (No at Step S107), and when there is no loaded banknote (Yes at Step S107), displays for confirmation the number of stored banknotes by denomination at that time on the operation terminal 110 as the deposited amount and the denomination breakdown (Step S108).

At this time, when a confirmation input (approval input) of the deposit has been received via the operation terminal 110 (Yes at Step S109), the storage/feed-unit balance update unit 130*d* adds and updates the deposited amount and the denomination breakdown, respectively, to the amount and the number of banknotes by denomination stored in the storage and feed unit 20 as the storage/feed unit balance information 120*d* (Step S110), and requests the host computer 200 of the bank to perform online deposit processing for adding the deposited amount to the balance of a bank account of the shop (Step S111), to finish the processing.

On the other hand, when a rejection input of the deposit has been received via the operation terminal 110 (No at Step S109), the depositing controller 130*a* performs "deposit return" for controlling the transport unit 16 to transport the banknotes from the respective stackers 21 to the dispensing port 13 based on the denomination breakdown of the deposited amount (Step S112), and finishes the processing.

In this manner, the deposited amount and the denomination breakdown are added and updated to the balance of the storage and feed unit 20 held by the bank and the online deposit processing for adding the deposited amount to the balance of the bank account of the shop is requested to the host computer 200. Accordingly, the balance of the storage and feed unit 20 can be accurately managed and the deposits and savings in the bank can be accurately managed.

Figure 12:
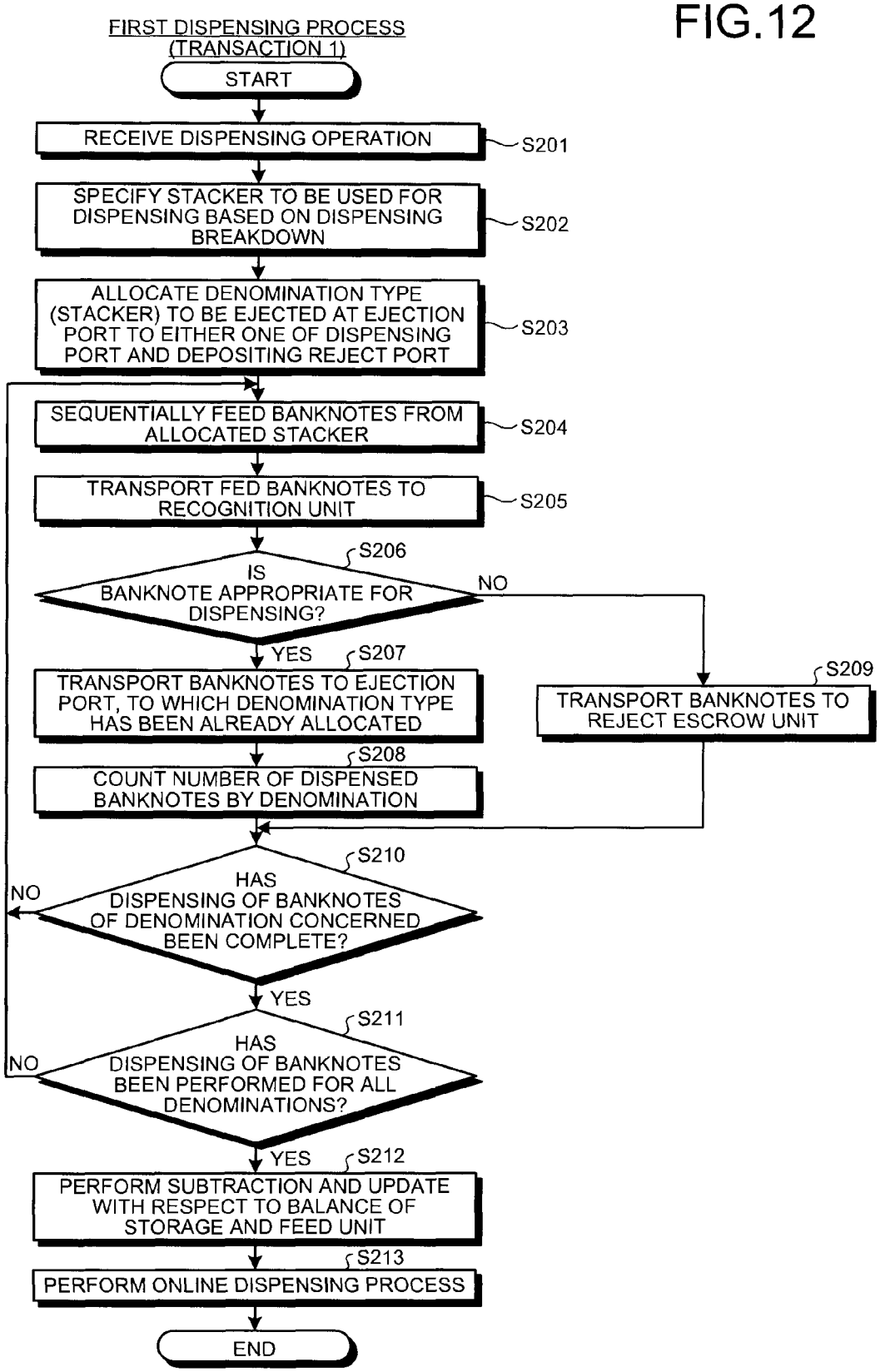
FIG. 12 is a flowchart of a first dispensing process procedure according to the embodiment.

A first dispensing processing (transaction 1) according to the present embodiment is explained next. FIG. 12 is a flowchart of a first dispensing process procedure according to the present embodiment.

As shown in FIG. 12, when an operation required as the preprocessing of the dispensing processing, for example, an input of the authentication information and an input of the content of the dispensing transaction (dispensing amount or dispensing breakdown) are received as the depositing operation (Step S201), the dispensing controller 130*b* specifies the stacker 21 to be used for dispensing based on the dispensing breakdown whose input has been received or a dispensing breakdown determined from the dispensing amount based on a predetermined condition (for example, combination of denominations with which the number of dispensed banknotes becomes minimum) (Step S202). When the type of the dispensing transaction is preparation of the change fund, the dispensing breakdown of the change fund stored in the memory unit 120 as the change information 120*b* can be loaded.

The dispensing controller 130*b* allocates the denomination type (stacker) to be ejected at the ejection port to either one of the dispensing port 13 and the depositing reject port 14 as the ejection port (Step S203). For example, the dispensing controller 130*b* preferentially allocates the denomination type to the ejection port, to which preferred setting of the transport destination stored in the memory unit 120 as the various setting information 120*c* is made.

Subsequently, the dispensing controller 130*b* sequentially feeds the banknotes from the allocated stacker 21 (Step S204), and controls the transport unit 16 to transport the fed banknotes to the recognition unit 12 (Step S205).

At this time, when the recognition unit 12 recognizes that the fed banknotes are banknotes appropriate for dispensing (Yes at Step S206), the dispensing controller 130*b* controls the transport unit 16 to transport the banknotes to the ejection port, to which the denomination type has been already allocated at Step S203 (Step S207), and counts the number of dispensed banknotes by denomination based on the recognized denomination (Step S208).

On the other hand, when the recognition unit 12 recognizes that the fed banknotes are banknotes inappropriate for dispensing (No at Step S206), the dispensing controller 130*b* controls the transport unit 16 to transport the dispensing reject banknotes to the reject escrow unit 15 (Step S209). The dispensing reject banknotes in the reject escrow unit 15 are transported and returned as explained in the deposit return or transported to the accumulating unit 31.

The dispensing controller 130*b* repeatedly performs the process from Steps S204 to S209 until the number of dispensed banknotes by denomination allocated to the ejection port becomes the number of banknotes of the denomination in the dispensing breakdown (No at Step S210). When the number of dispensed banknotes by denomination allocated to the ejection port becomes the number of banknotes by denomination in the dispensing breakdown (Yes at Step S210), the dispensing controller 130*b* determines whether dispensing has been performed for all denominations constituting the dispensing breakdown (Step S211).

When the dispensing has not been performed for all denominations constituting the dispensing breakdown (No at Step S211), the dispensing controller 130*b* repeatedly performs the process from Steps S204 to S210 so that the banknotes of a different denomination are ejected from an ejection port separate from the ejection port, to which the denomination type is allocated at Step S203.

When the dispensing has been performed for all denominations constituting the dispensing breakdown (Yes at Step S211), the storage/feed-unit balance update unit 130*d* subtracts and updates the dispensing amount and the dispensing breakdown (the number of banknotes by denomination), respectively, from the balance of the storage and feed unit 20 stored in the memory unit 120 as the storage/feed unit balance information 120*d* (Step S212), and requests the host computer 200 in the bank to perform online dispensing processing for subtracting and updating the dispensing amount from the balance of the bank account of the shop (Step S213), to finish the processing.

Thus, in the present embodiment, when the dispensing processing of one dispensing transaction is performed, the dispensing port 13 or the depositing reject port 14 is changed over as the transport destination for each type of denomination, and the transport unit 16 is controlled to transport the banknotes fed by the stacker 21.

Accordingly, for example, when the dispensing port 13 and the depositing reject port 14 are changed over as the transport destination for each denomination type, the banknotes can be divided by denomination and ejected to the dispensing port 13 and the depositing reject port 14, and the banknotes can be sorted by denomination and obtained as the dispensed banknotes. As a result, conveniences associated with sorting in the dispensing processing can be improved.

A case that when the dispensing processing of one dispensing transaction is performed, the dispensing port 13 and the depositing reject port 14 are changed over as the transport destination for each denomination type has been explained. However, the transport destination can be changed over according to not only the denomination type but also by country, denomination, fit/unfit, large/small amount, old/new banknotes, and front or back. All the fed banknotes can be transported to the dispensing port 13 or the depositing reject port 14. When one of the ejection ports becomes full, the banknotes can be transported to the other ejection port. Specification and changeover of the transport destination can be similarly applied to not only at the time of dispensing but also at the time of return such as deposit return.

Further, in the present embodiment, information about banknotes to be ejected to the dispensing port 13 or the depositing reject port 14 or information about the dispensing transaction can be displayed on the operation terminal 110 by controlling the transport unit 16.

For example, in an example shown in FIG. 13, a display example when the transport destination is changed over to the dispensing port 13 or the depositing reject port 14 for each denomination to dispense banknotes at the time of preparing the change fund has been described. At this time, by displaying that the banknotes ejected from the both ejection ports are for the same dispensing transaction in a situation in which the banknotes are being dispensed from both the dispensing port 13 and the depositing reject port 14, it can be prevented that the shop operator is confused. Further, by displaying the amount already dispensed currently of the total amount of the change fund and the number of banknotes by denomination already dispensed (the amount and number of banknotes already dispensed), or the amount and the number of banknotes by denomination not dispensed of specified dispensing amount (the amount and number of banknotes not dispensed), the progress of the dispensing transaction can be accurately ascertained.

Figure 14:
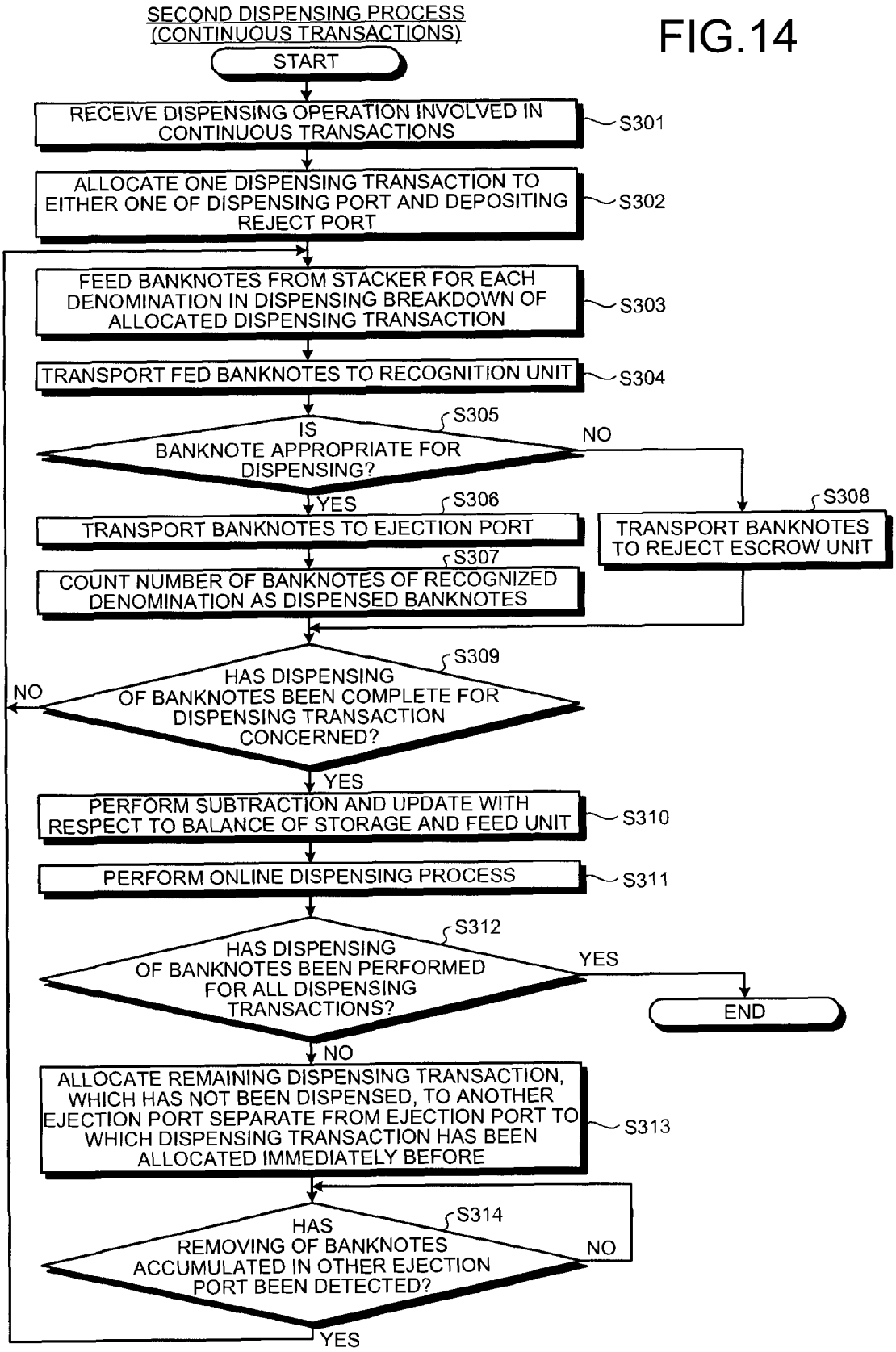
FIG. 14 is a flowchart of a second dispensing process procedure according to the embodiment.

A second dispensing process (a continuous transaction) according to the present embodiment is explained next. FIG. 14 is a flowchart of a second dispensing process procedure according to the present embodiment.

As shown in FIG. 14, the dispensing controller 130*b* receives an operation required as the preprocessing of the dispensing processing, for example, an input of the authentication information and an input of a content of the continuous dispensing transaction (dispensed amount and dispensing breakdown) as the dispensing operation (Step S301). For example, when the type of the continuous dispensing transaction is preparation of the change fund, the dispensing breakdown of the change fund stored in the memory unit 120 as the change information 120*b* can be loaded.

The dispensing controller 130*b* allocates the dispensing transaction (preparation of the change fund for cash register NO. m1) to either one of the dispensing port 13 and the depositing reject port 14 so that the banknotes are ejected from the allocated ejection port (Step S302). For example, the dispensing controller 130*b* preferentially allocates the denomination type to the ejection port, to which preferred setting of the transport destination stored in the memory unit 120 as the various setting information 120*c* is made.

Subsequently, the dispensing controller 130*b* sequentially feeds the banknotes from the allocated stacker 21 for each denomination in the dispensing breakdown of the dispensing transaction (Step S303), and controls the transport unit 16 to transport the fed banknotes to the recognition unit 12 (Step S304).

At this time, when the recognition unit 12 recognizes that the fed banknotes are banknotes appropriate for dispensing (Yes at Step S305), the dispensing controller 130*b* controls the transport unit 16 to transport the banknotes to the ejection port, to which the dispensing transaction has been already allocated at Step S302 (Step S306), and counts the number of dispensed banknotes by denomination based on the recognized denomination (Step S307).

On the other hand, when the recognition unit 12 recognizes that the fed banknotes are banknotes inappropriate for dispensing (No at Step S305), the dispensing controller 130*b* controls the transport unit 16 to transport the dispensing reject banknotes to the reject escrow unit 15 (Step S308). The dispensing reject banknotes in the reject escrow unit 15 are transported and returned as explained in the deposit return or transported to the accumulating unit 31.

The dispensing controller 130*b* repeatedly performs the process from Steps S303 to S308 until the number of dispensed banknotes by denomination in the dispensing transaction becomes equal to the dispensing breakdown (No at Step S309).

When the number of dispensed banknotes by denomination in the dispensing transaction becomes equal to the dispensing breakdown (Yes at Step S309), the storage/feed-unit balance update unit 130*d* subtracts and updates the dispensing amount and the dispensing breakdown (the number of banknotes by denomination), respectively, from the balance of the storage and feed unit stored in the memory unit 120 as the storage/feed unit balance information 120*d* (Step S310), and requests the host computer 200 in the bank to perform the online dispensing processing for subtracting the dispensing amount from the balance of the bank account of the shop (Step S311).

When dispensing has not been performed for all the dispensing transactions (preparation of change fund for all cash registers) (No at Step S312), the dispensing controller 130*b* changes over the transport destination to the other ejection port separate from the ejection port, to which the dispensing transaction (preparation of the change fund for cash register NO. m1) has been allocated immediately before, to allocate thereto the remaining type of denomination of the dispensing transaction, which has not been dispensed (Step S313).

At this time, when the banknotes have not been accumulated in the other ejection port (Yes at Step S314), the dispensing controller 130*b* sequentially feeds the banknotes for each denomination in the dispensing breakdown of the dispensing transaction from the stacker 21 (Step S303), to repeat the processing from Steps S304 to S311.

When dispensing is complete for all the dispensing transactions (preparation of the change fund for all cash registers) (Yes at Step S312), the dispensing controller 130*b* finishes the processing.

In the present embodiment, further, information about the banknotes ejected to the dispensing port 13 and the depositing reject port 14 or information about the dispensing transaction can be displayed on the operation terminal 110 by controlling the transport unit 16.

For example, in an example shown in FIG. 15, a screen example when the transport destination is changed over to the dispensing port 13 or the depositing reject port 14 for each register to dispense banknotes at the time of preparing the change fund for a plurality of registers is shown. In this case, by displaying for which register the banknotes ejected from the both ejection ports are used to prepare the change fund, in a situation in which the banknotes are being dispensed from both the dispensing port 13 and the depositing reject port 14, it can be prevented that the shop operator is confused. Further, by displaying a history of the register having finished dispensing, the number of registers which has currently completed dispensing of the change fund (the number of registers having finished dispensing) or the number of remaining registers which has not completed dispensing of the change fund (the number of registers not having finished dispensing) can be displayed, thereby enabling to accurately ascertain the progress of the dispensing transaction.

In the dispensing controller 130*b*, a case that the change fund is dispensed for each cash register number has been explained. However, if the change information is registered in the memory unit 120 for each operator number of the cash register (hereinafter, "cashier number"), the change fund can be dispensed for each cashier.

A case that the change fund is automatically dispensed has been explained here. However, the present invention is not limited thereto, and the dispensing processing of the change fund can be started when the cash register number or the cashier number is given from an input unit of a server (a higher-level device) connected to the instruction receiving unit 111 of the operation terminal 110 or the money handling apparatus 1 via a network or the like.

That is, in the dispensing controller 130*b*, when the cash register number or the cashier number is given from the instruction receiving unit 111 of the operation terminal 110 or the input unit of the higher-level device, the change fund can be dispensed for each cash register number or the cashier number.

At this time, the dispensing controller 130*b* collates the cash register number or the cashier number input via the instruction receiving unit 111 of the operation terminal 110 with the cash register number or the cashier number included in establishment information registered in the memory unit 120 of the money handling apparatus 1 or in the higher-order device. When the cash register number or the cashier number matching the establishment information is registered therein, the dispensing controller 130*b* can dispense the change fund corresponding to the cash register number or the cashier number.

The establishment information is data associated with the cash register number or the cashier number operated on business day for each business day or business day type, and for example, the number of cash registers or cashiers operated on one business day, a site where the cash register is operated, and a cashier who is on duty are distinctly registered, between a busy day such as the fifth and tenth day of each month, and Saturday, Sunday, and holidays and a non-busy day.

In the present embodiment, further, a case that the dispensing port 13 and the depositing reject port 14 are changed over for dispensing as the transport destination of the dispensed banknotes for each denomination and cash register number has been explained. However, the dispensed banknotes can be ejected basically by only one ejection port of the dispensing port 13 or the depositing reject port 14, and only when a predetermined condition is satisfied, the transport destination can be changed to the other ejection port for dispensing automatically or after reception of assignment. Hereinafter, it is assumed that the dispensing port 13 is set as a primary dispensing destination of the dispensed banknotes.

For example, as such a predetermined condition, when a condition that the dispensing port 13 as the primary dispensing destination is fully loaded with the dispensed banknotes, that is, the dispensing port 13 is in a full state or a nearly-full state is satisfied, even if the dispensing port 13 has been set as the dispensing destination of the dispensed banknotes, the dispensed banknotes are transported to the depositing reject port 14 and dispensed, upon reception of an operation for specifying the depositing reject port 14 as a temporary dispensing destination via the instruction receiving unit 111 of the operation terminal 110. In this case, a full-state detecting unit such as a photo sensor that detects whether the dispensing port 13 is fully loaded with the banknotes needs to be provided at the dispensing port 13.

Accordingly, the number of banknotes that cannot be dispensed at a time from only one ejection port (dispensing port 13) set as the primary dispensing destination can be bypassed to the other ejection port (depositing reject port 14) as the temporary dispensing destination and dispensed at a time, thereby enabling to improve the dispensing efficiency.

As such a predetermined condition, when such conditions that a transport error that cannot transport the dispensed banknotes to the dispensing port 13 as the primary dispensing destination is detected and that there is no banknote in the depositing reject port 14 are satisfied, upon reception of an operation for specifying the depositing reject port 14 as the temporary dispensing destination via the instruction receiving unit 111 of the operation terminal 110, the dispensed banknotes are transported to the depositing reject port 14 and dispensed. In this case, a presence detecting unit that detects the presence of the banknotes in the depositing reject port 14 needs to be provided in the depositing reject port 14.

Accordingly, even if a transport error such that the dispensed banknotes cannot be transported to the one ejection port (the dispensing port 13) set as the primary dispensing destination is detected by the transport unit 16, the dispensed banknotes can be transported to the other ejection port (the depositing reject port 14) as the temporary dispensing destination, thereby enabling to improve the dispensing efficiency.

A case that the dispensing port 13 is set as the primary dispensing destination and the depositing reject port 14 is set as the temporary dispensing destination has been explained here. However, even when the dispensing port 13 is set as the temporary dispensing destination and the depositing reject port 14 is set as the primary dispensing destination, same effects can be achieved by adopting the same configuration.

While a case of dispensing the change fund has been described in the present embodiment, the present invention is not limited thereto, and the invention can be applied in the same manner to dispensing of banknotes to be loaded in another machine such as an ATM and other dispensing transactions such as dispensing at the time of exchange.

Figure 16:
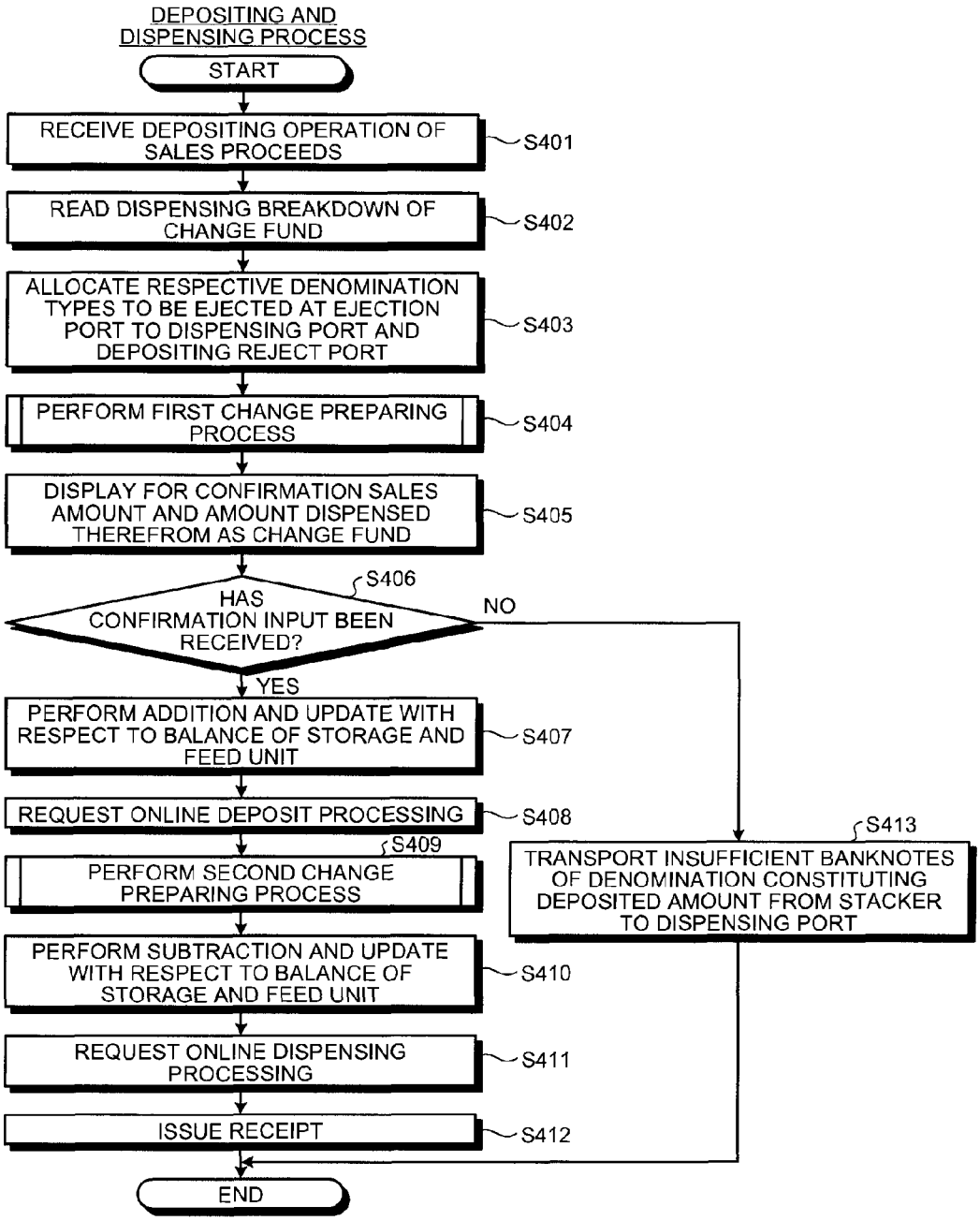
FIG. 16 is a flowchart of a depositing-and-dispensing process procedure according to the embodiment.

A depositing and dispensing process according to the present embodiment is explained next. FIG. 16 is a flowchart of a depositing-and-dispensing process procedure according to the present embodiment.

As shown in FIG. 16, when an operation required as the preprocessing of the depositing and dispensing process, for example, upon reception of an input of the authentication information, an input of the cash register number, and a loading operation of banknotes of sales proceeds as a depositing and dispensing operation (Step S401), the depositing controller 130*a* reads the dispensing breakdown of the change fund stored in the memory unit 120 as the change information 120*b* (Step S402).

The depositing controller 130*a* allocates the respective denomination types to be ejected at the ejection port to the both ejection ports of the dispensing port 13 and the depositing reject port 14 (Step S403), and performs a "first change preparing process" for directly dispensing the banknotes deposited as the sales proceeds, which can be reused, of the banknotes by denomination to be dispensed as the change fund, without storing in the stacker 21 (Step S404).

Figure 17:
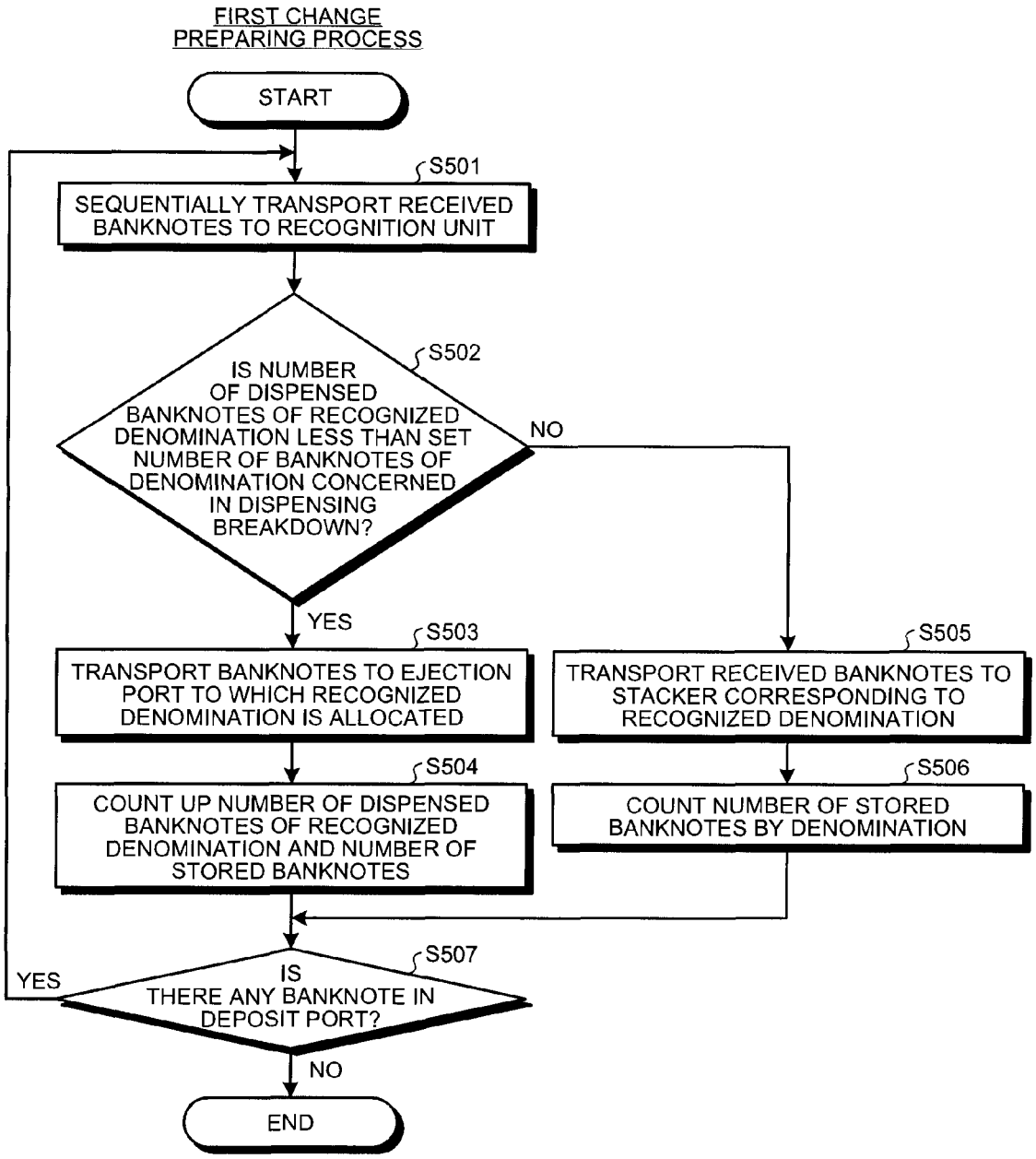
FIG. 17 is a flowchart of a first change-preparing process procedure according to the embodiment.

The first change preparing process according to the present embodiment is explained here. FIG. 17 is a flowchart of a first change-preparing process procedure according to the present embodiment.

As shown in FIG. 17, the depositing controller 130*a* controls the transport unit 16 to transport the banknote received in the apparatus to the recognition unit 12 (Step S501).

When the number of dispensed banknotes of the recognized denomination is less than the set number of banknotes of the denomination in the dispensing breakdown (Yes at Step S502), the depositing controller 130*a* controls the transport unit 16 to transport the banknotes to the ejection port to which the recognized denomination is allocated (Step S503), and counts up the number of dispensed banknotes of the recognized denomination and the number of stored banknotes (Step S504). The reason why the number of stored banknotes is counted up is to regard that the sales proceeds is stored in the stacker 21.

On the other hand, when the banknotes of the recognized denomination has been ejected up to the set number of banknotes of the denomination in the dispensing breakdown (No at Step S502), the depositing controller 130*a* controls the transport unit 16 to transport the received banknotes to the stacker 21 corresponding to the recognized denomination, and counts the number of stored banknotes by denomination (Steps S505 and S506).

The depositing controller 130*a* repeatedly performs the process from Steps S501 to S506 until there is no banknote loaded in the deposit port 11 (No at Step S507). When there is no loaded banknote (Yes at Step S507), the depositing controller 130*a* proceeds to Step S405 shown in FIG. 16.

Returning to the explanation of FIG. 16, the depositing controller 130*a* displays for confirmation the sales amount (that is, a counted value of the number of banknotes by denomination stored at Steps S504 and S506) and the amount dispensed therefrom as the change fund (that is, counted value of the number of dispensed banknotes by denomination at Step S504) on the operation terminal 110 after the "first change preparing process" is complete (Step S405).

When the confirmation input (approval input) of deposit is received via the operation terminal 110 (Yes at Step S406), the storage/feed-unit balance update unit 130*d* adds and updates the deposited amount and the denomination breakdown deposited without being reused, respectively, as the change fund to the balance of the storage and feed unit 20 stored in the memory unit 120 as the storage/feed unit balance information 120*d* (Step S407), and requests the host computer 200 in the bank to perform the online deposit processing for adding the deposited amount to the balance of the bank account of the shop (Step S408).

Subsequently, the dispensing controller 130*b* performs a "second change preparing process" to fill the deficit, which occurs because the number of dispensed banknotes does not reach the set number of the change fund in the first change preparing process performed at Step S404, by dispensing the banknotes from the stacker 21 (Step S409).

Figure 18:
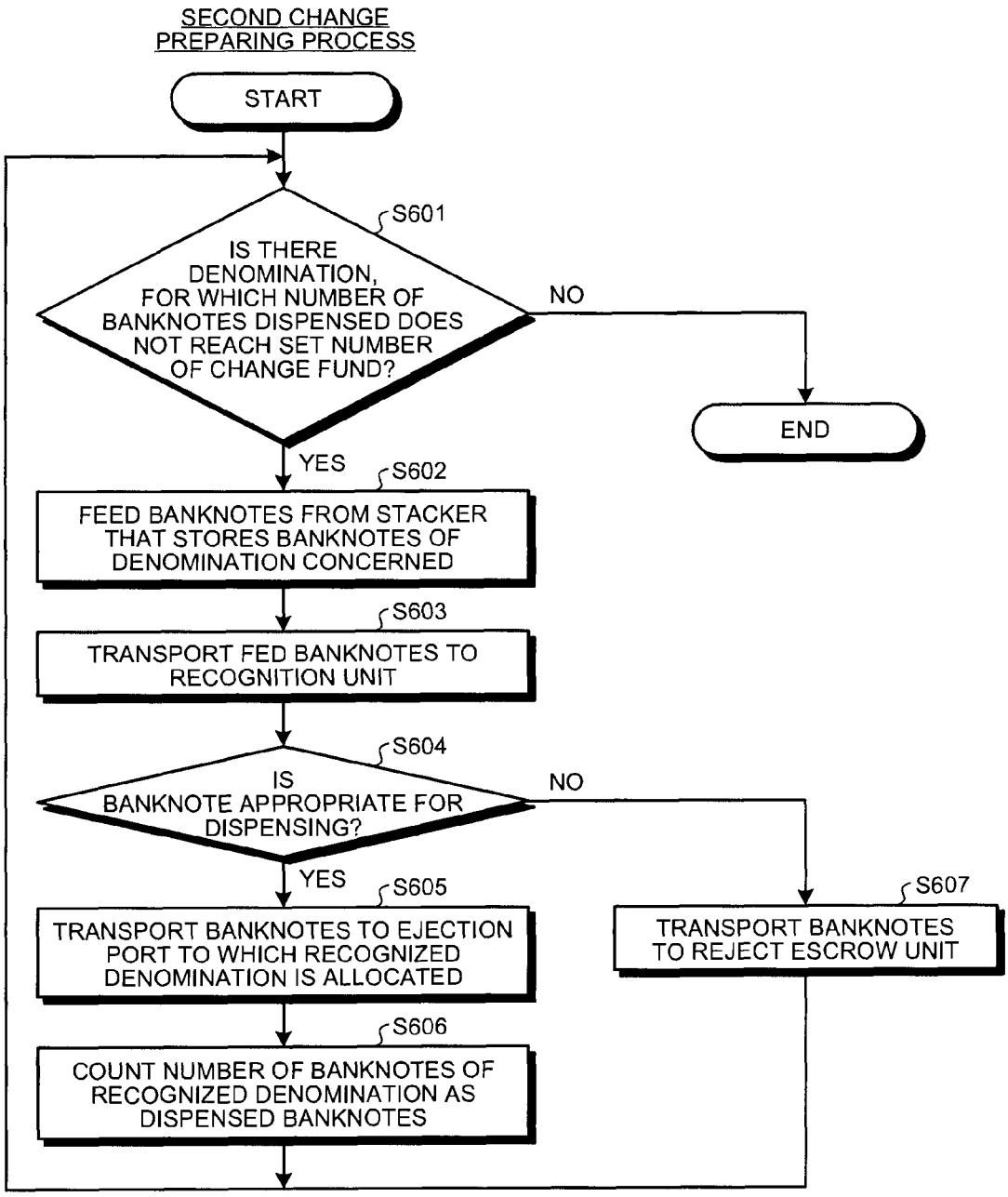
FIG. 18 is a flowchart of a second change-preparing process procedure according to the embodiment.

The second change preparing process according to the present embodiment is explained here. FIG. 18 is a flowchart of a second change-preparing process procedure according to the present embodiment.

As shown in FIG. 18, the dispensing controller 130*b* determines whether there is a denomination in which the number of dispensed banknotes of the denomination is insufficient for the set number of the change fund (Step S601).

At this time, when there is a denomination in which the number of dispensed banknotes of the denomination is insufficient for the set number of the change fund (Yes at Step S601), the dispensing controller 130*b* sequentially feeds the banknotes from the stacker 21 that stores the banknotes of the denomination in short supply (Step S602), and controls the transport unit 16 to transport the fed banknotes (Step S603).

When the recognition unit 12 recognizes that the fed banknotes are banknotes appropriate for dispensing (Yes at Step S604), the dispensing controller 130*b* controls the transport unit 16 to transport the banknotes to the ejection port to which the recognized denomination is allocated (Step S605), and counts the number of dispensed banknotes by denomination based on the recognized denomination (Step S606).

On the other hand, when the recognition unit 12 recognizes that the fed banknotes are banknotes inappropriate for dispensing (No at Step S604), the dispensing controller 130*b* controls the transport unit 16 to transport the dispensing reject banknotes to the reject escrow unit 15 (Step S607). The dispensing reject banknotes in the reject escrow unit 15 are transported and returned as explained in the deposit return or transported to the accumulating unit 31.

The dispensing controller 130*b* repeatedly performs the process from Steps S602 to S607 until the number of dispensed banknotes by denomination reaches the set number of the change fund (Yes at Step S601). When the number of dispensed banknotes of each denomination reaches the set number of the change fund (No at Step S601), the dispensing controller 130*b* finishes the process.

Returning to the explanation of FIG. 16, after the "second change preparing process" is complete, the storage/feed-unit balance update unit 130*d* subtracts and updates the amount of the change fund and the dispensing breakdown (the number of banknotes by denomination), respectively, from the balance of the storage and feed unit 20 stored in the memory unit 120 as the storage/feed unit balance information 120*d* (Step S410), and requests the host computer 200 in the bank to perform the online dispensing processing for subtracting the dispensing amount from the balance of the bank account of the shop (Step S411). The storage/feed-unit balance update unit 130*d* then causes the printing unit 114 to print the sales amount and denomination breakdown thereof, and the amount of change fund and denomination breakdown thereof as a change preparation receipt (Step S412), to finish the process.

When a rejection input of the deposit is received via the operation terminal 110 (No at Step S406), the depositing controller 130*a* transports insufficient denomination of the banknotes whose number does not reach the number of banknotes of the denomination constituting the deposited amount (sales amount), among the dispensed banknotes by denomination, i.e., the change fund in the first change preparing process, from the corresponding stacker 21 to the dispensing port 13, in order to return to the state before the sales amount is deposited.

In the example shown in FIG. 16, when the request of the online dispensing processing is complete, the change preparation receipt is printed. However, by printing the change preparation receipt at a timing when removing of the banknotes dispensed as a change is detected or thereafter, the receipt can be printed linked with the change fund, so that it can be intuitively ascertained that the printed receipt is for the pulled out change fund.

Figure 19:
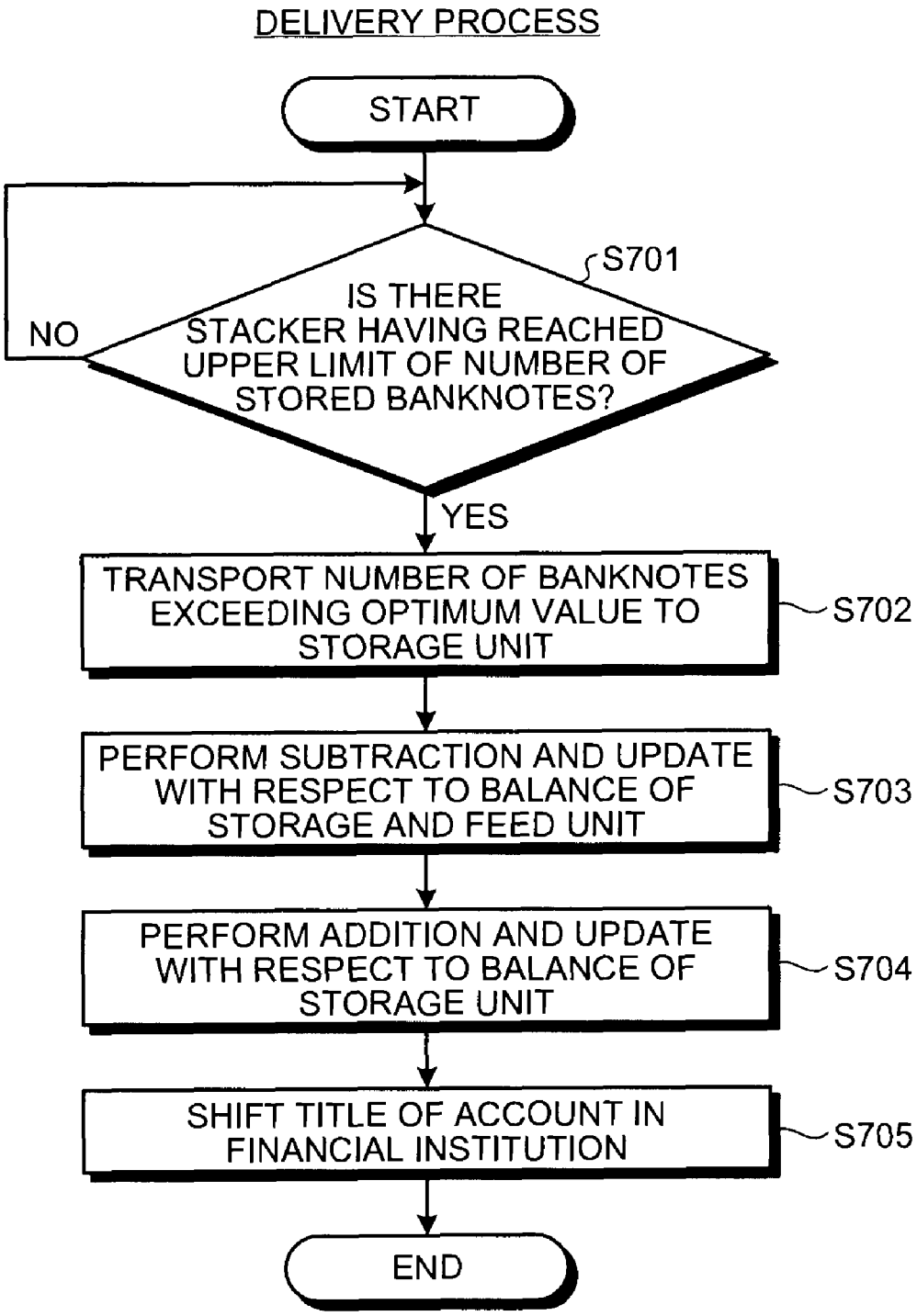
FIG. 19 is a flowchart of a delivery process procedure according to the embodiment.

A delivery process according to the present embodiment is explained next. FIG. 19 is a flowchart of a delivery process procedure according to the present embodiment.

As shown in FIG. 19, the delivery controller 130*c* determines whether there is a stacker 21 in which the number of stored banknotes has reached the upper limit stored in the memory unit 120 as the various setting information 120*c* (Step S701).

At this time, when there is a stacker 21 having reached the upper limit (Yes at Step S701), the delivery controller 130*c* leaves the optimum number of banknotes stored in the stacker 21 and transports the number of banknotes exceeding the optimum value to the accumulating unit 31 (Step S702).

The storage/feed-unit balance update unit 130*d* subtracts and updates the delivery amount and the dispensing breakdown (the number of banknotes by denomination), respectively, from the balance of the storage and feed unit stored in the memory unit 120 as the storage/feed unit balance information 120*d* (Step S703).

On the other hand, the storage-unit balance update unit 130*e* adds and updates the delivery amount and the denomination breakdown to the balance of the storage unit 30 stored in the memory unit 120 as the storage unit balance information 120*e* (Step S704). Further, the storage-unit balance update unit 130*e* subtracts the delivery amount from the balance of title of account "shop funds" in a financial institution and adds the delivery amount to the balance of title of account "normal funds" (Step S705), to finish the process.

Thus, even when there is a cash transport between the depositing and dispensing unit 10, the storage and feed unit 20, and the storage unit 30, the balance of the storage and feed unit 20 and the storage unit 30 can be accurately managed.

As described above, in the present embodiment, the money handling apparatus 1 is divided into the depositing and dispensing unit 10 that performs a depositing and dispensing process of banknotes, the storage and feed unit 20 that stores and feeds the banknotes, and the storage unit 30 that stores the banknotes. Because the depositing and dispensing unit 10, the storage and feed unit 20, and the storage unit 30 are configured such that three different parties concerned can handle only the part allowed to the party concerned, more than three parties concerned can be involved in handling of the banknotes.

In the present embodiment, further, because the transport control is performed to control the transport unit 16 to transport the dispensed banknotes to the depositing reject port 14, even if the dispensing port 13 cannot dispense the banknote due to a banknote jam or the like, the depositing reject port 14 can be operated as a bypass, thereby enabling to prevent a reduction of efficiency in the dispensing processing.

In the present embodiment, (3) of FIG. 2 has been mainly explained among the divisions of the handling right shown in FIG. 2. However, the present invention can be preferably applied also to (4) of FIG. 2. The difference between (3) of FIG. 2 and (4) of FIG. 2 is explained here.

That is, in the case of (4) of FIG. 2, because the shop has the handling right for both the depositing and dispensing unit 10 and the storage and feed unit 20, the online depositing is performed only when cash transport is performed from the storage and feed unit 20 to the storage unit 30.

In the case of (3) of FIG. 2, a case that the bank sets a delivery condition has been explained. However, in the case of (4) of FIG. 2, because the shop owns the storage and feed unit 20, the condition for delivering the banknotes from the storage and feed unit 20 to the storage unit 30 can be independently determined by the shop.

For example, an amount to be left in the shop after close of business of the shop is set, and the banknotes exceeding the set amount are delivered to the storage unit 30. In this case, it is desired to calculate the amount to be left based on a change of the balance or to determine a certain amount beforehand. Alternatively, the delivery amount is preset, and the delivery amount is delivered to the storage unit 30. In this case, the certain amount can be set as the delivery amount, or calculated based on the sales amount or the balance of the storage and feed unit 20. The delivery amount can be arbitrarily set or input.

In the above embodiment, the ATM fit note is dispensed from the dispensing port 13 or the depositing reject port 14. However, the ATM fit note does not need to be dispensed from the dispensing port 13 or the depositing reject port 14, and for example, while the ATM fit notes are accumulated in the reconciliation cassette 21G, the banknotes that do not satisfy a quality level specified as the ATM fit note can be held in the reject escrow unit 15, and transported to the respective stackers 21 after ATM fit dispensing.

Figure 20:
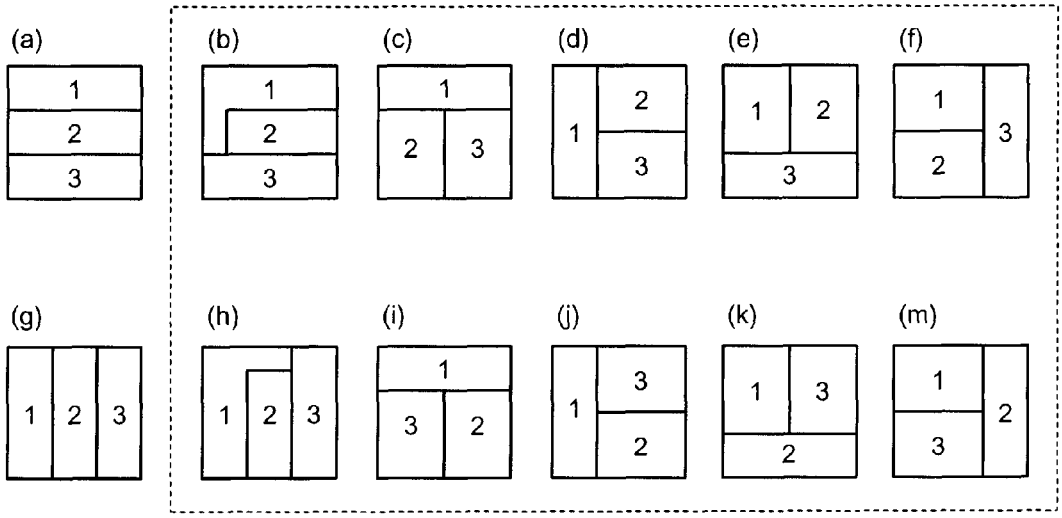
FIG. 20 depicts application examples of a layout of a depositing and dispensing unit, a storage and feed unit, and a storage unit according to the embodiment.

In the above embodiment, a case that the depositing and dispensing unit 10 is provided in an upper part, the storage and feed unit 20 in the middle, and the storage unit 30 in a lower part (see (a) of FIG. 20) has been explained. However, the present invention is not limited thereto, and for example, when layouts shown in (b) to (m) of FIG. 20 are employed, the present invention can be applied thereto in the same manner.

In the above embodiment, as shown in (a) of FIG. 21, cash can be delivered to the storage unit 30 only from the storage and feed unit 20. However, when the layouts shown in (b) to (f) and (h) to (m) of FIG. 20 are used, as shown in (b) and (d) of FIG. 21, the cash can be delivered directly from the depositing and dispensing unit 10 to the storage unit 30.

In the above embodiment, further, the banknotes are stored in the storage and feed unit 20 and the storage unit 30. However, a storage unit can be provided in the depositing and dispensing unit 10 to store the banknotes.

In the above embodiment, a case that the balance of the storage and feed unit 20 and the balance of the storage unit 30 are displayed on the operation terminal 110 so that the parties concerned of the shop, the bank, and the security company can view the balances has been explained. However, the present invention is not limited thereto, and the money handling apparatus 1 can be remotely operated by accessing thereto from an external device.

Figure 22:
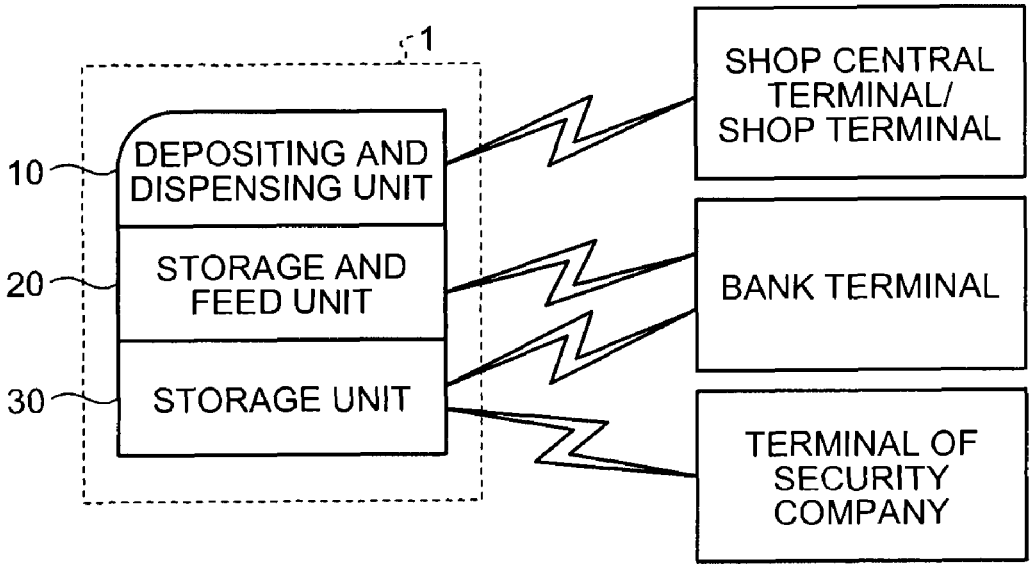
FIG. 22 is an example of an access right given to an external device.

An access right to the money handling apparatus from the external device is specifically explained below. FIG. 22 is an example of the access right given to the external device. As shown in FIG. 22, as examples of the external device connected to the money handling apparatus 1, there are a shop terminal arranged in the shop, which is handled by the shop operator and the shop manager who are the parties concerned of the shop, a shop central terminal arranged in a head office of the shop, which is handled by the party concerned of the shop, a bank terminal handled by the parties concerned of the bank such as the maintenance personnel who performs maintenance of the money handling apparatus as a representative of the bank and bank clerks, and a terminal of the security company handled by the party concerned thereof.

As described above, the external device includes a plurality of terminals belonging to different parties concerned. However, setting of the access right enabling remote control of the processing associated with either one of the depositing and dispensing unit 10, the storage and feed unit 20, and the storage unit 30 by an access from outside (for example, a right to view the balance of the storage and feed unit 20 or the storage unit 30 from the external device) can be set arbitrarily.

In the example shown in FIG. 22, with regard to the operation right and unlocking right of the depositing and dispensing unit 10, the access right is given to the shop central terminal and the shop terminal. With regard to the operation right and unlocking right of the storage and feed unit 20, the access right is given to the bank terminal. With regard to the operation right and unlocking right of the storage unit 30, the access right is given to the terminal of the security company.

Not only in a case that the parties concerned as shown in (3) of FIG. 2 are involved in the money handling apparatus 1, but also in a case that other parties concerned are involved in the money handling apparatus 1, for example, the parties concerned as shown in (4) of FIG. 2 are involved in the money handling apparatus 1, the access right can be set.

Figure 23:
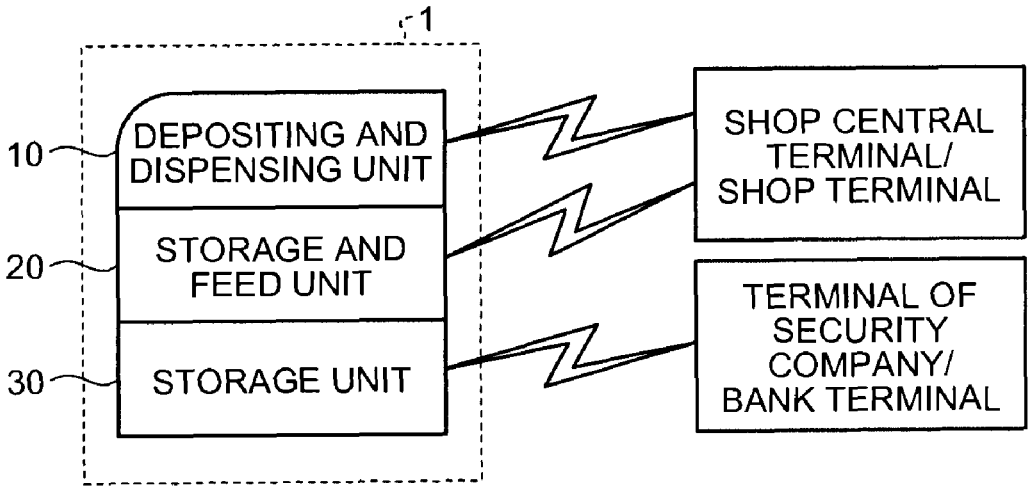
FIG. 23 is an example of an access right given to the external device.

FIG. 23 is an example of the access right given to the external device. As shown in FIG. 23, as examples of the external device, there are the shop central terminal, shop terminal, terminal of the security company, and bank terminal. Each terminal is a PC, a mobile terminal, or a job-oriented terminal, and connected via a wired or wireless network. The reason why the bank terminal is included here is that the ownership of the banknotes stored in the storage unit 30 is held by the bank.

In the example shown in FIG. 23, with regard to the operation right and unlocking right of the depositing and dispensing unit 10 and the storage and feed unit 20, the access right is given to the shop central terminal and the shop terminal, and with regard to the operation right and unlocking right of the storage unit 30, the access right is given to the terminal of the security company and the bank terminal.

The money handling apparatus 1 stores the access right given to the external device in the memory unit 120, to determine whether an access from the external device is from a device having the access right. As a result, in the case of the external device having the access right, the money handling apparatus 1 determines whether the processing requested by the external device is included in the access right.

At this time, when the access from the external device is an access from the device having the access right, and the processing requested by the external device is included in the access right, the money handling apparatus 1 performs the processing in response to the request.

On the other hand, when the access from the external device is not an access from the device having the access right, or even if the external device has the access right, when the processing requested by the external device is not included in the access right, the money handling apparatus 1 does not perform the processing.

Accordingly, only in the processing for which the external device belonging to the party concerned has the access right, remote control can be performed by the access from outside.

For example, in the example shown in FIG. 22, only when there is an access for requesting to view the balance of the storage and feed unit 20 from the bank terminal, the balance of the storage and feed unit 20 is transmitted to the bank terminal. Only when there is an access for requesting to view the balance of the storage unit 30 from the bank terminal or the terminal of the security company, the balance of the storage unit 30 can be transmitted to the bank terminal or the terminal of the security company.

In the example shown in FIG. 23, only when there is an access for requesting to view the balance of the storage and feed unit 20 from the shop central terminal or the shop terminal, the balance of the storage and feed unit 20 is transmitted to the shop central terminal or the shop terminal. Further, only when there is an access for requesting to view the balance of the storage unit 30 from the bank terminal or the terminal of the security company, the balance of the storage unit 30 can be transmitted to the bank terminal or the terminal of the security company.

In the example, further, the online deposit processing and the online dispensing processing are performed at the time of performing the depositing and dispensing process. However, the online processing for the depositing and dispensing performed in a certain period can be performed collectively at a predetermined timing.

For example, the depositing and dispensing amounts and the number of banknotes by denomination in the depositing and dispensing transactions for one day stored in the memory unit 120 as the depositing and dispensing information 120*a* are summed up as sum total of deposited amount and the sum total of dispensed amount, and the sum total of deposited amount and the sum total of dispensed amount can be processed online, or total amount of deduction between the deposited amount and the dispensed amount or the number of banknotes by denomination of the total amount of deduction can be processed online.

In the present invention, upon reception of a request from the operation terminal 110 or the external device, at least one of the online deposit processing and the online dispensing processing can be performed. For example, the online deposit processing and the online dispensing processing can be performed by consolidating the depositing and dispensing transactions accumulated and stored in the memory unit 120 as the depositing and dispensing information 120*a* for a period since the last online-processing of the depositing and dispensing until reception of an instruction this time.

Further, in the present embodiment, depositing and dispensing are performed regardless of whether it is the front or back of a banknote. In the present invention, however, by including the reject escrow unit 15 and the reconciliation cassette 21G in a route of banknotes at the time of depositing or in a route of banknotes at the time of dispensing, the front and back are reversed, and the deposited banknotes can be stored in the stacker 21 with the front and back being sorted, or the banknotes can be dispensed from the dispensing port 13 or the depositing reject port 14 with the front and back being sorted.

For example, when it is set such that banknotes are stored in the stacker 21 in a state with the front face thereof facing upward, if the banknote is fed into the inside of the apparatus from the deposit port 11 with the front face thereof facing downward, the recognition unit 12 recognizes that the front face of the banknote faces downward, and the banknote is temporarily stored in the stacker of the recognized denomination. The banknote stored in the stacker 21 is fed out and transported to the reject escrow unit 15 and held therein, and thereafter, transported to the stacker 21 through the recognition unit 12 again. Accordingly, all the banknotes to be stored in the stacker 21 can be stored with the front face being upward.

When it is set such that banknotes are dispensed at the dispensing port 13 in a state with the front face thereof facing upward, the banknotes stored in the stacker 21 with the front face being downward are transported to the reject escrow unit 15 and held therein, and dispensed from the dispensing port 13. Accordingly, all the banknotes to be dispensed from the dispensing port 13 can be dispensed with the front face being upward.

In the present embodiment, a case that the three parties of the shop, the bank, and the security company have the handling right has been explained. However, the present invention is not limited to a case that the parties concerned are three, and is also applicable to a case that the parties concerned are four or more by providing a fourth part having either one function of the storage and feed unit 20 and the storage unit 30.

For example, when a storage unit 40 having the same function as that of the storage unit 30 shown in FIG. 1 is provided separately, a bank in the United States owns the storage unit 30, and a bank in Canada owns the storage unit 40, the money handling apparatus 1 can be configured such that U.S. dollars fed from the storage and feed unit 20 are delivered to the storage unit 30, and Canadian dollars fed therefrom are delivered to the storage unit 40.

In the above embodiment, functional units of the operation terminal 110, the memory unit 120, and the control unit 130 can be provided in any part of the first, second, and third parts in a consolidated manner or in a distributed manner. These functional units can be provided in each part.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A money handling apparatus for handling money, comprising:

a depositing unit that deposits a money;

a transport unit that transports the money;

a recognition unit that recognizes the money;

a money storage unit that stores the money;

a dispensing unit that dispenses the money;

a reject unit that ejects a rejected money that cannot be accepted in a deposit process, the reject unit having an opening from which the rejected money can be removed; and, a control unit configured to control the transport unit in a dispensing process such that the money that is dispensed from the money storage unit and can be dispensed for the dispensing process, is transported to the dispensing unit and the reject unit under a predetermined condition.

2. The money handling apparatus according to claim 1, further comprising an instructing unit, wherein the predetermined condition includes a case that a plurality of dispensing transactions are instructed by the instructing unit, and the control unit controls the transport unit such that the money is transported from the money storage unit to a destination that is switched between the dispensing unit and the reject unit for each of the dispensing transactions, when the dispensing transactions instructed by the instructing unit are performed.

3. The money handling apparatus according to claim 1, further comprising an instructing unit, wherein the predetermined condition includes a case that a plurality of dispensing processes are instructed, by the instructing unit, each of the dispensing processes is for dispensing a predetermined number of money, and the control unit controls the transport unit such that the money is transported from the money storage unit to a destination that is switched between the dispensing unit and the reject unit for every predetermined number of money.

4. The money handling apparatus according to claim 1, further comprising an instructing unit, wherein the predetermined condition includes a case that a plurality of dispensing processes are instructed, by the instructing unit, each of the dispensing processes is for dispensing a predetermined type of money, and the control unit controls the transport unit such that the money is transported from the money storage unit to a destination that is switched between the dispensing unit and the reject unit for every predetermined type of money.

5. The money handling apparatus according to claim 1, further comprising an instructing unit, wherein the predetermined condition includes a case that a plurality of dispensing processes are instructed, by the instructing unit, each of the dispensing processes is for dispensing a predetermined amount of money, and the control unit controls the transport unit such that the money is transported from the money storage unit to a destination that is switched between the dispensing unit and the reject unit for every predetermined amount of money.

6. The money handling apparatus according to claim 1, further comprising an operating unit, wherein the predetermined condition includes a case that the reject unit is specified as a dispensing destination in addition to the dispensing unit by the operating unit, and the control unit controls the transport unit such that the money is transported from the money storage unit to the reject unit, when the reject unit is specified as the dispensing destination by the operating unit.

7. The money handling apparatus according to claim 1, further comprising a full-capacity detecting unit that detects the dispensing unit in a nearly-full state or a full state, wherein the control unit controls the transport unit such that the money is transported from the money storage unit to the reject unit, when the full-capacity detecting unit detects that the dispensing unit is in the nearly-full state or the full state.

8. The money handling apparatus according to claim 1, further comprising:

a transport-error detecting unit that detects a transport error of moneys; and a presence detecting unit that detects a presence of moneys in the reject unit, wherein the control unit controls the transport unit such that the money is transported from the money storage unit to the reject unit, when the transport-error detecting unit detects a transport error that prevents the money from being transported to the dispensing unit, and the presence detecting unit detects that there is no money in the reject unit.

9. The money handling apparatus according to claim 1, further comprising a display unit, wherein the control unit controls the display unit to display information about money dispensed to the dispensing unit or the reject unit or information about a dispensing transaction.

10. The money handling apparatus according to claim 1, further comprising a display unit, wherein the control unit controls the display unit to display information about money dispensed to the reject unit.

* * * * *